US005554390A

United States Patent [19]

Anne et al.

[11] Patent Number: 5,554,390

[45] Date of Patent: Sep. 10, 1996

[54] COATINGS WITH SECOND PHASE PARTICULATE TO IMPROVE ENVIRONMENTAL PROTECTION

[75] Inventors: Joshi Anne; Jen S. Lee, both of Cupertino, Calif.

[73] Assignee: Lockheed Missiles & Space Company, Inc., Sunnyvale, Calif.

[21] Appl. No.: 189,425

[22] Filed: Jan. 31, 1994

Related U.S. Application Data

[63] Continuation-in-part of Ser. No. 188,401, Jan. 28, 1994, abandoned.

[51] Int. Cl.[6] ..... C03C 27/02

[52] U.S. Cl. ..... 428/631; 428/634; 427/199; 427/376.2; 427/419.1; 427/419.7

[58] Field of Search ..... 427/199, 376.2, 427/419.1, 419.7; 428/631, 634

[56] References Cited

U.S. PATENT DOCUMENTS

| | | | |
|---|---|---|---|
| 2,929,741 | 3/1960 | Steinberg | 117/114 |
| 3,619,430 | 11/1971 | Hiratsuko et al. | 264/29 |
| 4,092,459 | 5/1978 | Deffeyes et al. | 428/403 |
| 4,535,035 | 8/1985 | Smialek et al. | 428/698 |

OTHER PUBLICATIONS

H. S. Hu, A. Joshi, & J. S. Lee "Microstructural evaluations of a Si–Hf–Cr fused slurry coating on graphite for oxidation protection"—May/Jun. 1991—pp. 1535–1538—J. Vac. Sci. Technology.

Charles Packer & Roger A. Perkins "Development of a Fused Slurry Silicide coating for the protection of tantalum alloys"—pp. 361–378—Journal of the Less–Common Metals (1974).

James L. Smialek "Processing of Fused Silicide Coatings for Carbon–Based Materials"—pp. 757–783—Ceramic Engineering and Science Proceedings, vol. 4, No. 9–10, Sep.–Oct. 1983.

*Primary Examiner*—Benjamin Utech

*Attorney, Agent, or Firm*—Feix & Feix; H. Donald Volk

[57] ABSTRACT

A fine, hard particulate is distributed within a fused coating on a substrate. The distributed, fine, hard particulate function as crack arresters, so that a propagating crack is actually stopped upon encounter with the hard particle, and enhance nucleation during the coating formation, so that finer grain size is achieved within the coating, which in effect decreases the crack length in the coating.

36 Claims, 18 Drawing Sheets

FIG. 1

Si-30wt%Hf-10wt%Cr Slurry Coated Graphite
Fused at 1300°C, 20 min.
After Cyclic Oxidation for 4 h at 1300 -1200°C Si-22wt%Ti Slurry Coated Graphite
Fused at 1400°C, 20 min.
After Oxidation at 1300°C

CARBIDE PARTICULATE WITHIN A LAYERED COATING

Si-30wt.%Hf-10wt%Cr (I Coat) + Si-30wt.%Hf-10wt%Cr-1wt.%C (II Coat)

Fused at 1400°C 20 min.

COATINGS WITH SECOND PHASE PARTICULATE TO IMPROVE ENVIRONMENTAL PROTECTION

CROSS REFERENCE TO RELATED U.S. APPLICATION

This application is a continuation-in-part of U.S. patent application Ser. No. 08/188,401 filed Jan. 28, 1994, and entitled "MULTIPHASE COATINGS TO LOCALIZE CRACKING", Attorney Docket No. P-03-871 (F-1176-P), Joshi Anne and Jen Steven Lee (inventors), and assigned to the same assignee as the assignee of this application. This application became abandoned on Apr. 7, 1995.

This application claims the benefit of the filing date for the subject matter which is common to the parent application Ser. No. 08/188,401 filed Jan. 28, 1994.

BACKGROUND OF THE INVENTION

This invention relates to coatings on substrates for protecting the substrates from undesirable environmental reactions.

This invention relates to methods of providing a surface of a carbon based material, metal, metal alloy, or ceramic substrate with a crack limiting coating which prevents developing cracks from extending through the coating both under isothermal conditions and when the temperature is changed. The through-crack preventing coating prevents oxygen, or other reactive agents ambient to the coating, from penetrating through the coating and contacting the substrate.

This invention relates particularly to introducing fine particulate (such as silicon carbide, hafnium oxide, zirconium oxide, aluminum oxide, silicon oxide, hafnium nitride, silicon nitride, hafnium diboride, or similar compounds) into the coating.

Carbon—carbon composites and graphite undergo catastrophic oxidation at elevated temperatures when oxygen is available to carbon based substrate. Other substrate materials can also require protection from oxygen or other reactive agents ambient to a protective coating.

Oxidation prevention requires complete encapsulation with a protective material. The coating should have no continuous cracks or porosity, in order to achieve such protection.

Carbon based substrates require protection for many aerospace applications.

Many conventional coatings, including those deposited by CVD methods, are prone to cracking because of a large difference in coefficient of thermal expansion (CTE) between carbon and most of the potential coating materials. The large difference in CTE leads to tensile stresses in cool down and associated cracking of the coatings.

Some coatings suffer from poor adhesion to the substrate, also leading to coating failure.

For appropriate functioning, coatings should be mechanically and chemically stable under extreme thermal and oxidative environments, should provide good adhesion to the substrate, and should offer good thermal shock resistance, low oxygen and carbon permeability, and should offer low reactivity with the substrate at the operating temperatures.

Coatings should also, desirably, possess minimal mismatch in CTE with the substrate.

Ceramic compounds, such as oxides, carbides, silicides, nitrides, and borides are often employed as coatings. The ceramic compounds provide good performance at high temperatures, but the ceramic compounds are brittle and have a large CTE mismatch with carbon based substrates. The ceramic compounds therefore tend easily to crack.

A number of methods have been used in preparing protective coatings.

These methods include chemical vapor deposition (CVD), physical vapor deposition (PVD), pack cementation and a combination of pack cementation and CVD.

Coating materials have been prepared in layered structures in attempts to minimize the effects of CTE mismatch. Layering has been aimed at grading the CTE as well as improving the compatibility between layers and the substrate.

Another approach to coatings has involved fused slurry processing. The fused slurry processing has been applied to the processing of Al—Si and Ni—Si slurry coatings on C—C composites. Coatings using these transition metals were not totally protective in the 1,200° C. cyclic oxidation test because of incomplete coverage, volatilization losses or localized oxidation at the cracks in the coating.

The simplicity and attractive economics of the slurry coating process (as compared to the more expensive CVD and PVD processes) is, however, a strong motivation for using that slurry coating process, if it is possible to obtain successful results.

SUMMARY OF THE PRESENT INVENTION

It is a primary object of the present invention to provide a surface of a carbon based material, metal, metal alloy or ceramic substrate with a crack limiting coating which prevents developing cracks from extending through the coating both under isothermal conditions and when the temperature is changed.

It is a specific object of the present invention to provide the surface of a substrate with a through crack limiting coating by using a fused slurry process which is highly effective, economical, and which eliminates the through-crack problems presented by the prior art coating processes.

It is a specific object of the present invention to introduce fine particulate (such as silicon carbide, hafnium oxide, zirconium oxide, aluminum oxide, silicon oxide, hafnium nitride, silicon nitride, hafnium diboride, or similar compounds) into the coating for the purposes of enhancing grain refinement, causing hard particulate to function as crack arresters of cracks transmitted across grain boundaries and permitting coated specimens to be used at higher temperatures than specimens which do not have the particulate in the coating.

In accordance with the present invention a multilayer coating with hard particulate is applied to the surface of a substrate. The coating can be applied by a slurry coating method, chemical vapor deposition (CVD), physical vapor deposition (PVD), and various thermal spray techniques.

At least one of the layers of the multilayer coating is adhered tightly to the surface of the substrate.

The present invention produces a microstructure of fine grain, multiple phases (including distributed hard particulate) in the multiple layers.

In the microstructure all of the grains of all of the phases in at least one layer are small sized grains which are significantly smaller than the thickness of the layer.

In the microstructure at least one of the phases comprises a refractory material. The refractory material provides good resistance to oxidation at high temperature, but has a large enough CTE mismatch with the substrate so as to be subject to cracking of grains under thermal stresses incurred during operation.

The microstructure includes at least a second phase which comprises grains having a CTE mismatch with the substrate intermediate the mismatch CTE of the refractory material phase.

The grains of the second phase predominantly surround individual grains of the first phase, and hard particulate is distributed in grain boundaries between the grains in the microstructure.

The second phase has a sufficiently low mismatch in CTE with substrate material so as to cause a crack which extends through a grain in the first phase to be blunted and dissipated in an adjacent grain, or grains, of the second phase.

The microstructure distributes cracks to individual grains in the first phase and limits the distributed cracks to the individual grains to make all of the cracks discontinuous and to prevent any crack from extending through all of the layers of the entire coating.

To maintain all the grains small, the fusion of the coating is accomplished at the lowest temperature and the shortest time permissible to achieve a dense uniform coating.

The coating mixture to be fused contains at least one refractory metal, an element which lowers the melting point of the slurry mixture by eutectic melting, and fine particulate.

In one preferred embodiment of the present invention, the coating mixture contains one or more refractory metals selected from a group comprising hafnium, chromium, titanium, and zirconium. The mixture includes silicon which can form the desired microstructure. The silicon can also lower the melting point of the slurry mixture to eutectic melting. And the mixture contains fine particulate such as carbon (–325 mesh size) or one or more of the oxides or nitrides or similar chemicals noted above.

The fusion or reaction of the coating produces phases (produced by the fusion or reaction or retained in the desired form during the fusion or reaction) of refractory metals, metal silicides, carbides and elemental silicon. One of the phases is a fine, hard particulate which is distributed in and between grains of the other phases and which serves as a hard obstacle to crack propagation.

The fusion of a slurry is done at a temperature in the range 1300° C. to 1450° C. for up to about twenty minutes.

In a specific embodiment of the invention in which the coating is produced by the fusion of a slurry mixture, the coating comprises a first, thin layer of a refractory metal carbide and a silicon carbide adhered tightly to the carbon based substrate.

A second, thin layer of silicon carbide extends outwardly from the first layer.

A third, thick layer of multiphases containing refractory metal silicides and elemental silicon extends outwardly from the first and second layers. This third, thick layer (in particular) has fine, hard particulate distributed in and between grains of the other phases in the layer. The fine hard particulate enhance grain refinement in the layer, and the resulting fine grains minimize the opportunity for through coating cracks. The fine hard particulate also function as crack arresters of cracks transmitted across grain boundaries in the layer.

The grains of the refractory metal silicides in the third layer have a relatively high mismatch of the CTE with the CTE of the carbon based substrate. This layer has a relatively low CTE mismatch of the elemental silicon with the CTE of the carbon based substrate. Each high mismatch CTE grain of metal silicide is predominantly surrounded by lower CTE mismatch grains of silicon.

This microstructure enables the cracks to be distributed to individual grains of metal silicides and enables the surrounding grains of elemental silicon to blunt the distributed cracks.

The fine hard particulate also arrest cracks transmitted from the metal silicide grains.

This microstructure makes all cracks discontinuous and prevents any crack from extending through the entire coating.

Methods and structures which incorporate the features described above and which are effective to function as described above constitute further, specific objects of the invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles.

Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

FIG. 1 is an optical metallographic image of a cross section of a CMT graphite substrate coated with a single coat of slurry comprising 60 wt % Si—30 wt % Hf—10 wt % Cr. The coating was fused at 1400° C. for twenty minutes.

The scale of the image in FIG. 1 (and in each of the subsequent FIGS. 2–10) is indicated in the lower right hand corner of the Figure.

Figure 4:
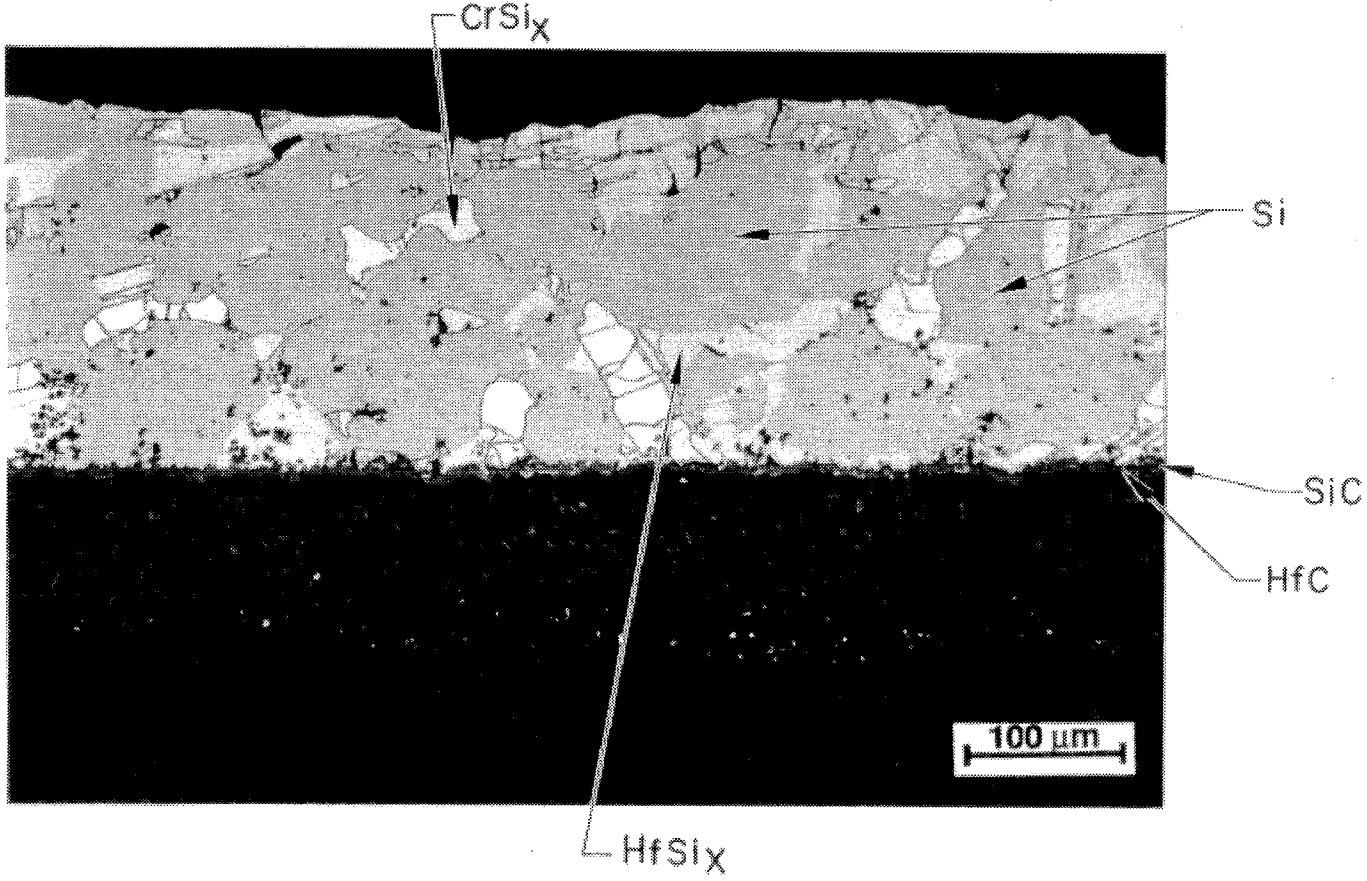

FIG. 4 is an optical metallographic image of cross section, in the etched condition, of a DFP-2 graphite substrate coated with a two coats of slurry. Each coat comprised 60 wt % Si—30 wt % Hf—10 wt % Cr. Each coat was fused at 1300° C. for twenty minutes.

Figure 5:
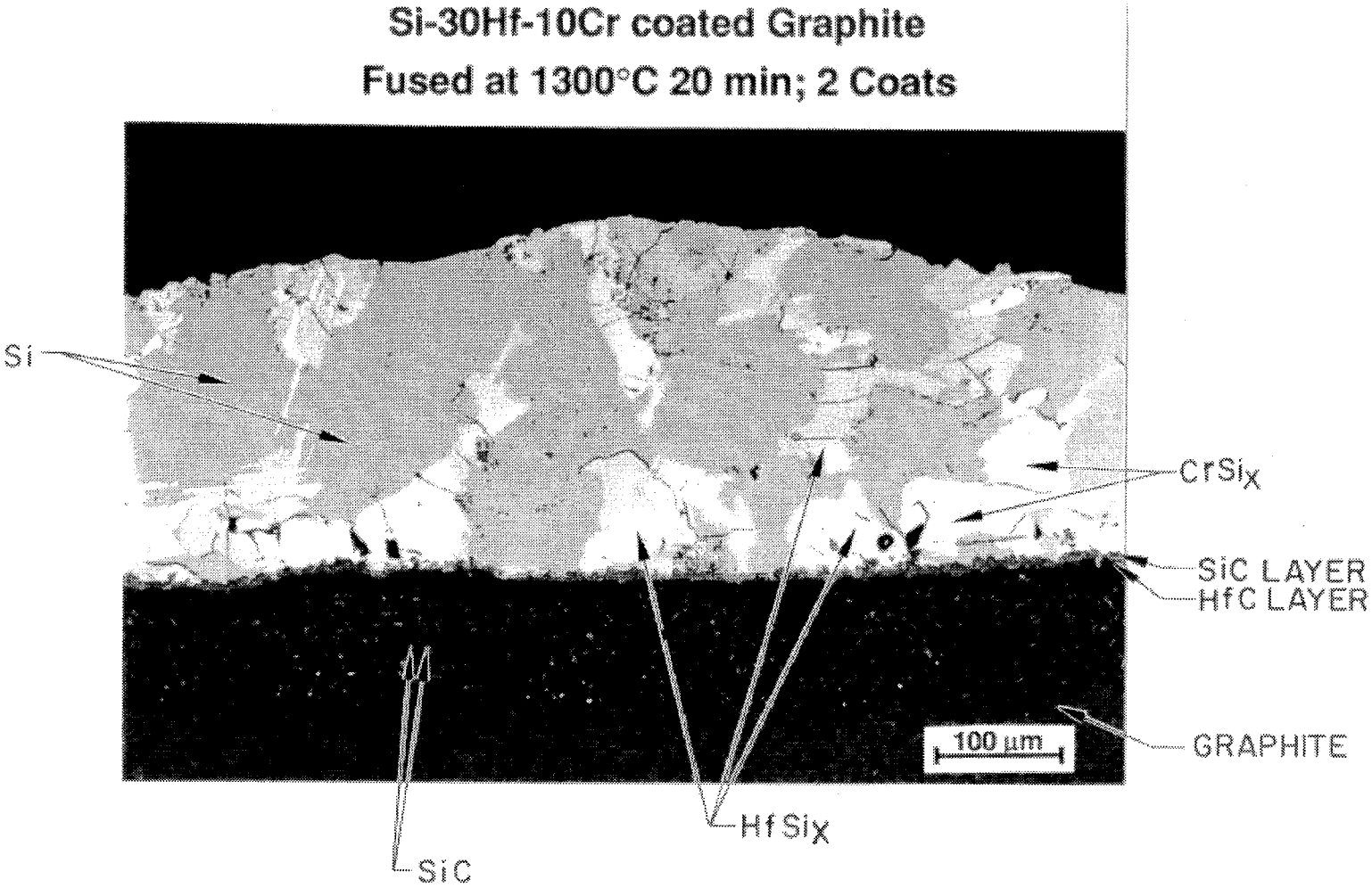

FIG. 5 is an optical metallographic image of a cross section, in the as polished condition, of a DFP-2 graphite substrate coated with two coats of slurry each coat comprising 60 wt % Si—30 wt % Hf—10 wt % Cr. Each coat was fused at 1300° C. for twenty minutes.

Figure 6:
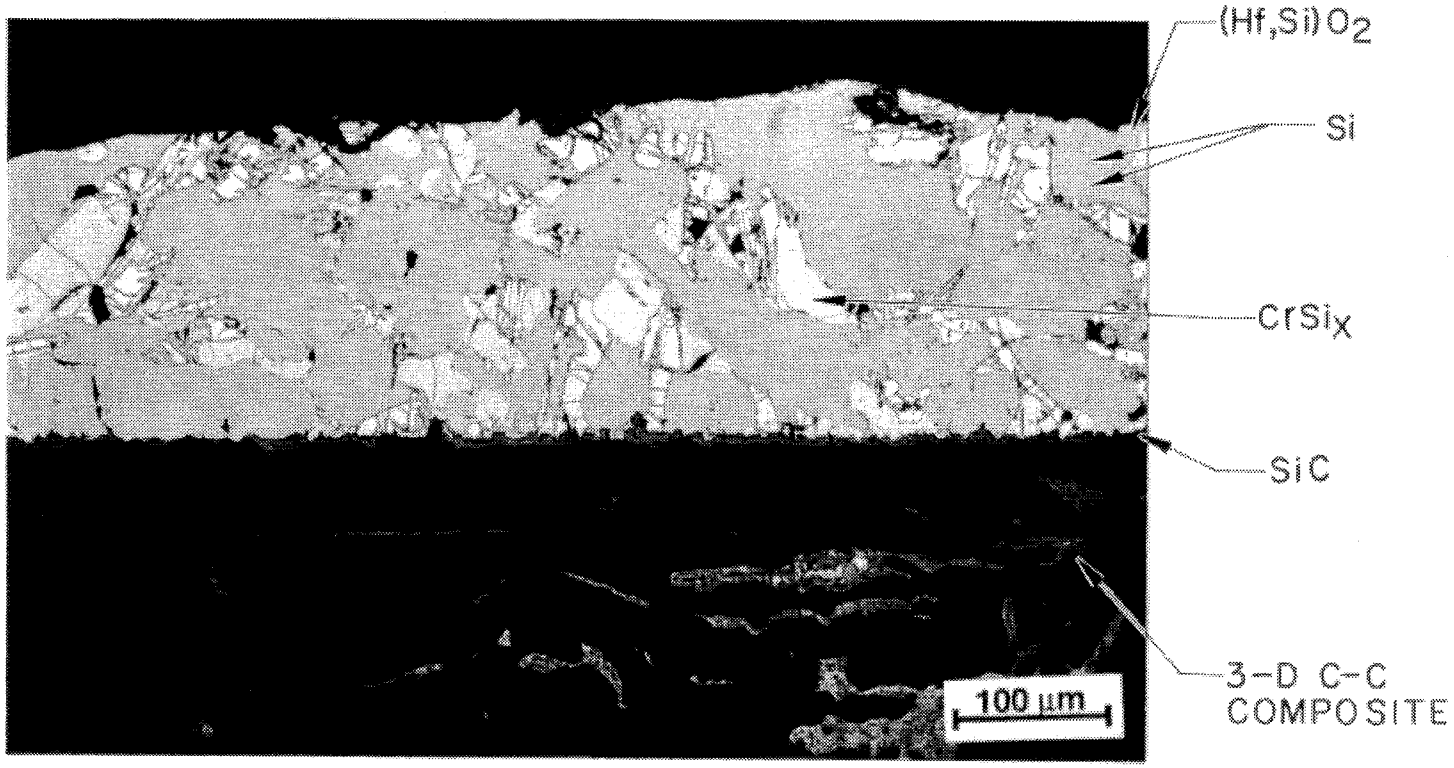

FIG. 6 is an optical metallographic image of a cross section of a 3-D C/C composite graphite substrate coated with a single coat of slurry comprising 60 wt % Si—30 wt % Hf—10 wt % Cr. The coating was fused at 1300° C. for twenty minutes. The structure of the coating shown in FIG. 6 is the structure existing after being oxidized for one hour in air at 1300° C.

Figure 7:
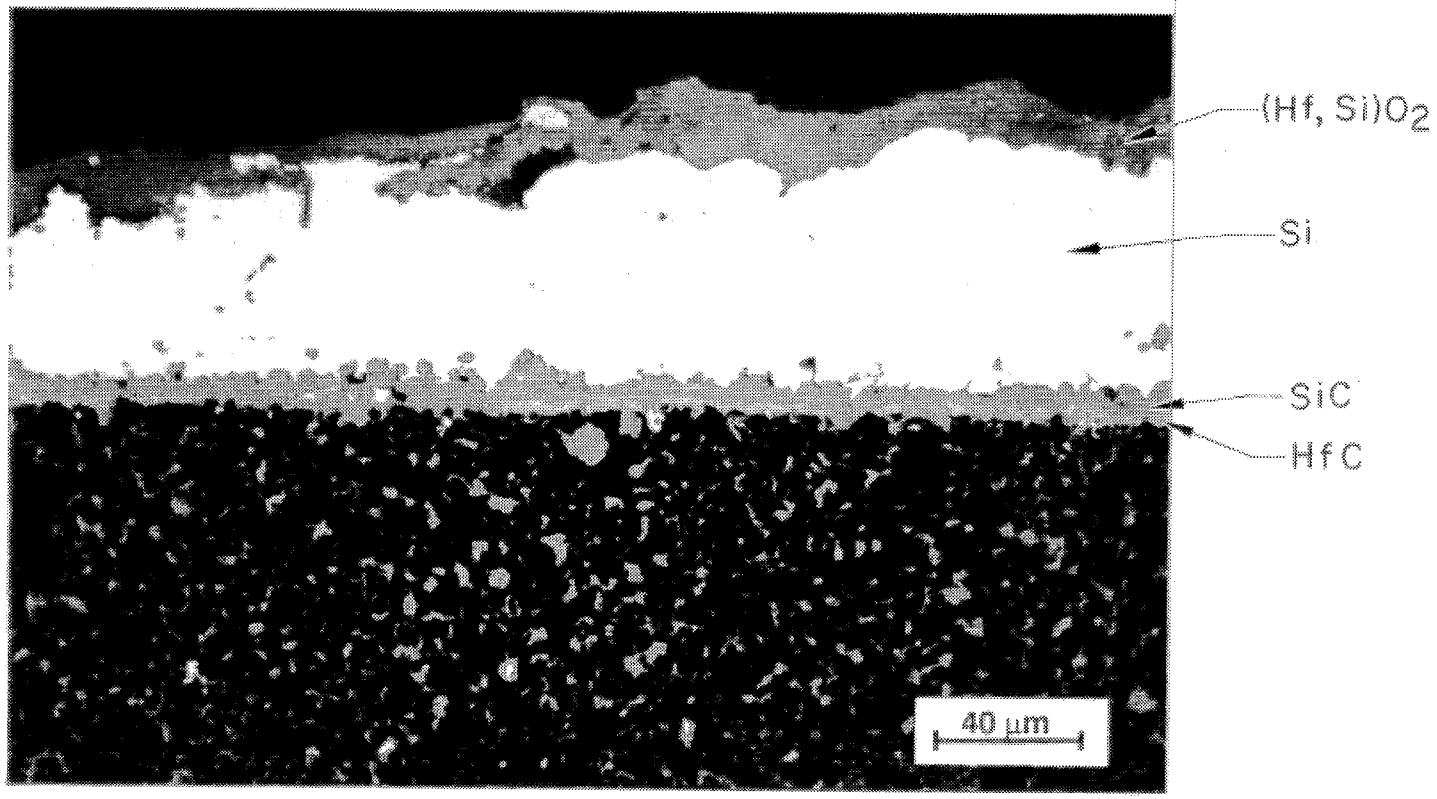

FIG. 7 is an optical metallographic image of a cross section of a DFP-2 graphite substrate coated with two coats of slurry each comprising 60 wt % Si—30 wt % Hf—10 wt % Cr. Each coat was fused at 1300° C. for twenty minutes. The structure of the coating shown in FIG. 7 is the structure existing after being subjected to four hours of cyclic oxidation similar to that shown in FIG. 14. In this cyclic oxidation the sample was cycled from 400° C. to a temperature in the range of 1200° C. to 1300° C., following which the microstructure shown in FIG. 7 was obtained. In practice the specimen was heated to the 1200° C. to 1300° C. range rapidly and was held in that range for one hour and then was lowered to 400° C. rapidly and was held at 400° C. for a few minutes. This cycle was repeated for four cycles.

Figure 8:
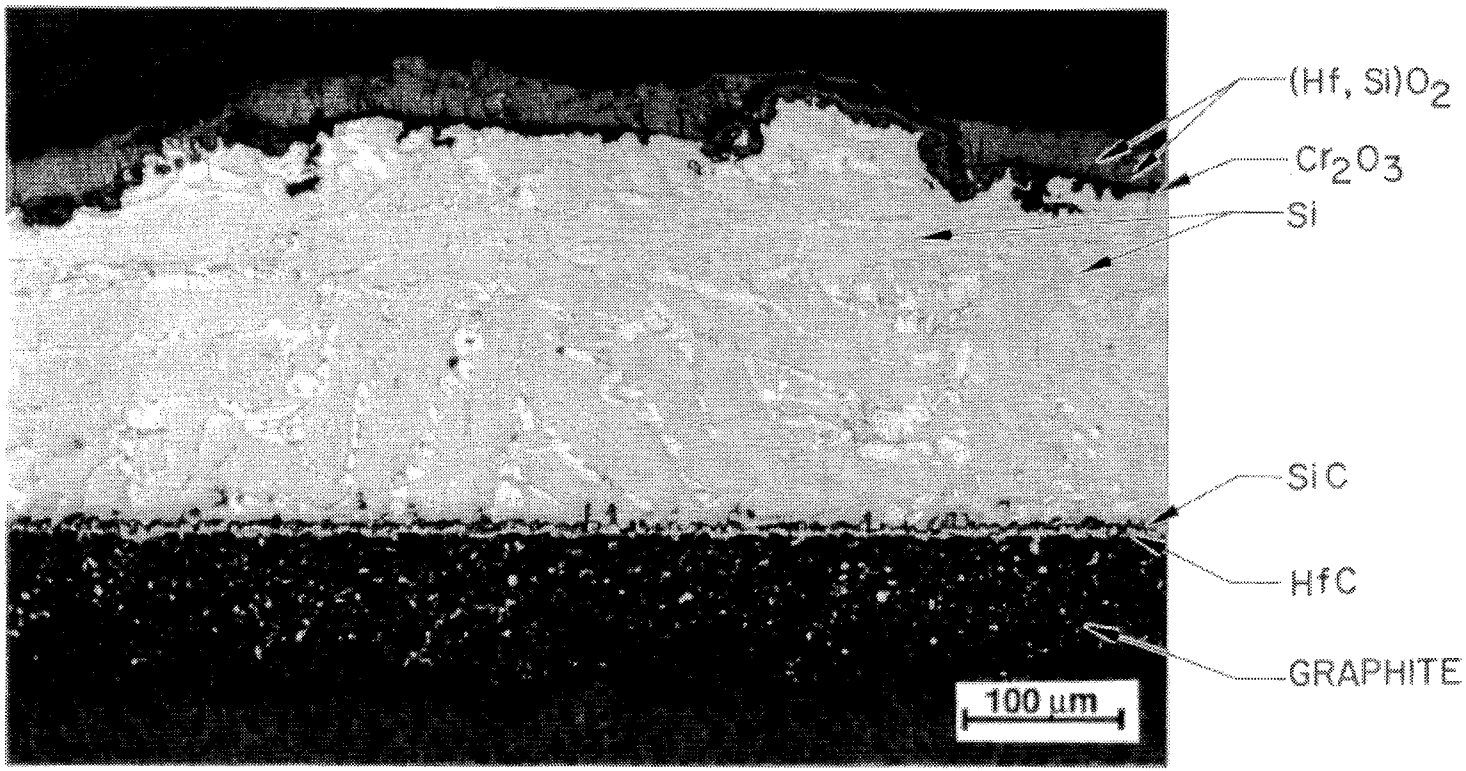
Figure 1:
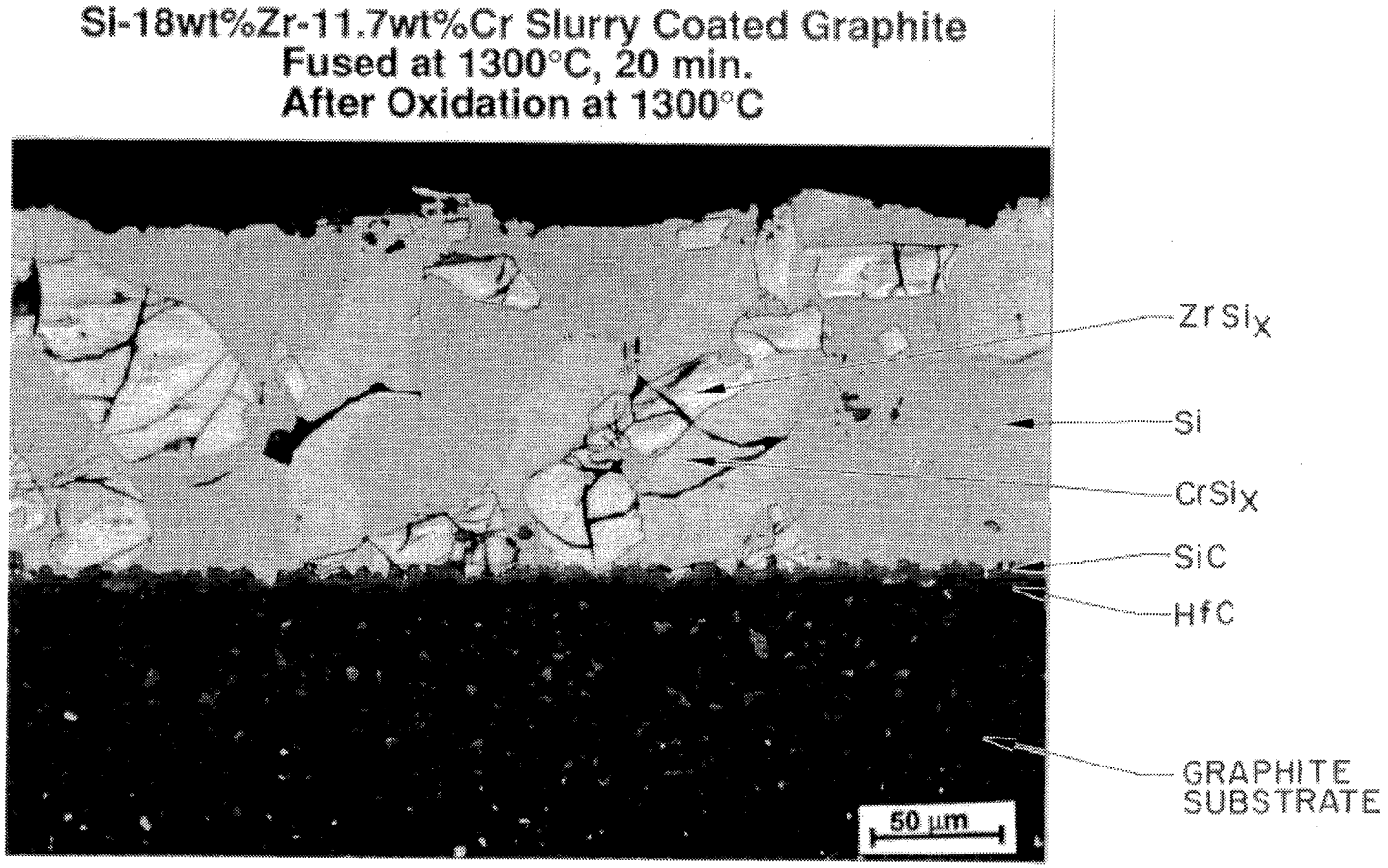

FIG. 8 is an optical metallographic image of a cross section of the DFP-2 graphite substrate coated with two coats of slurry, each comprising 60 wt % Si—30 wt % Hf—10 wt % Cr. Each coat was fused at 1300° C. for twenty minutes. The structure of the coating shown in FIG. 8 is the structure existing after being oxidized for one hour in air at 1500° C.

FIG. 9 is an optical metallographic image of a cross section of a DFP-2 graphite substrate coated with two coats of slurry, each coat comprising 70.3 wt % Si—18 wt % Zr—11.7 wt % Cr. Each coat was fused at 1300° C. for twenty minutes. The structure of the coating shown in FIG. 9 is the structure existing after being oxidation tested for one hour in air at 1300° C.

FIG. 10 is an optical metallographic image of a cross section of a DFP-2 graphite substrate coated with two coats of slurry, each coat comprising 78 wt % Si—22 wt % Ti. Each coat was fused at 1400° C. for twenty minutes. The structure ore the coating shown in FIG. 10 is the structure existing after being oxidation tested for one hour in air at 1300° C.

Figure 11:
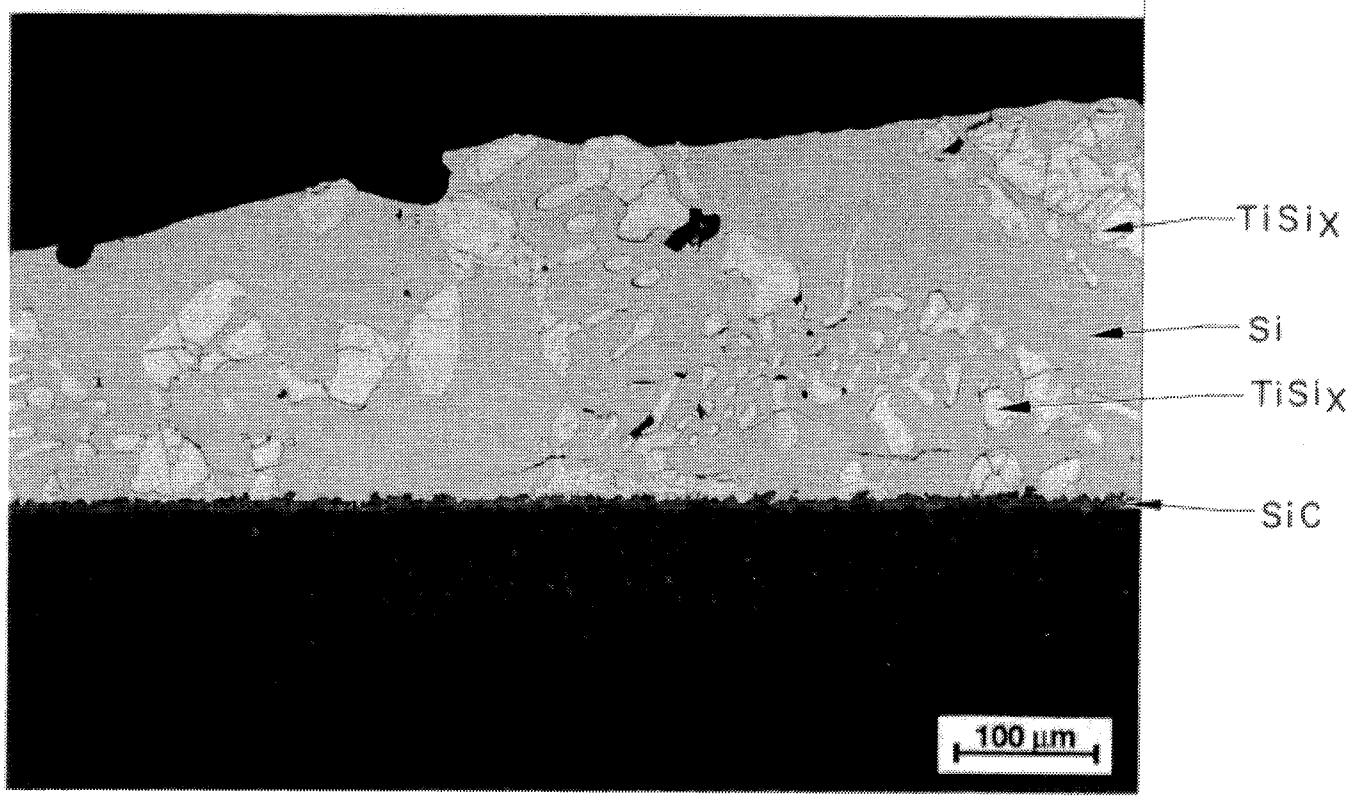
Figure 11:
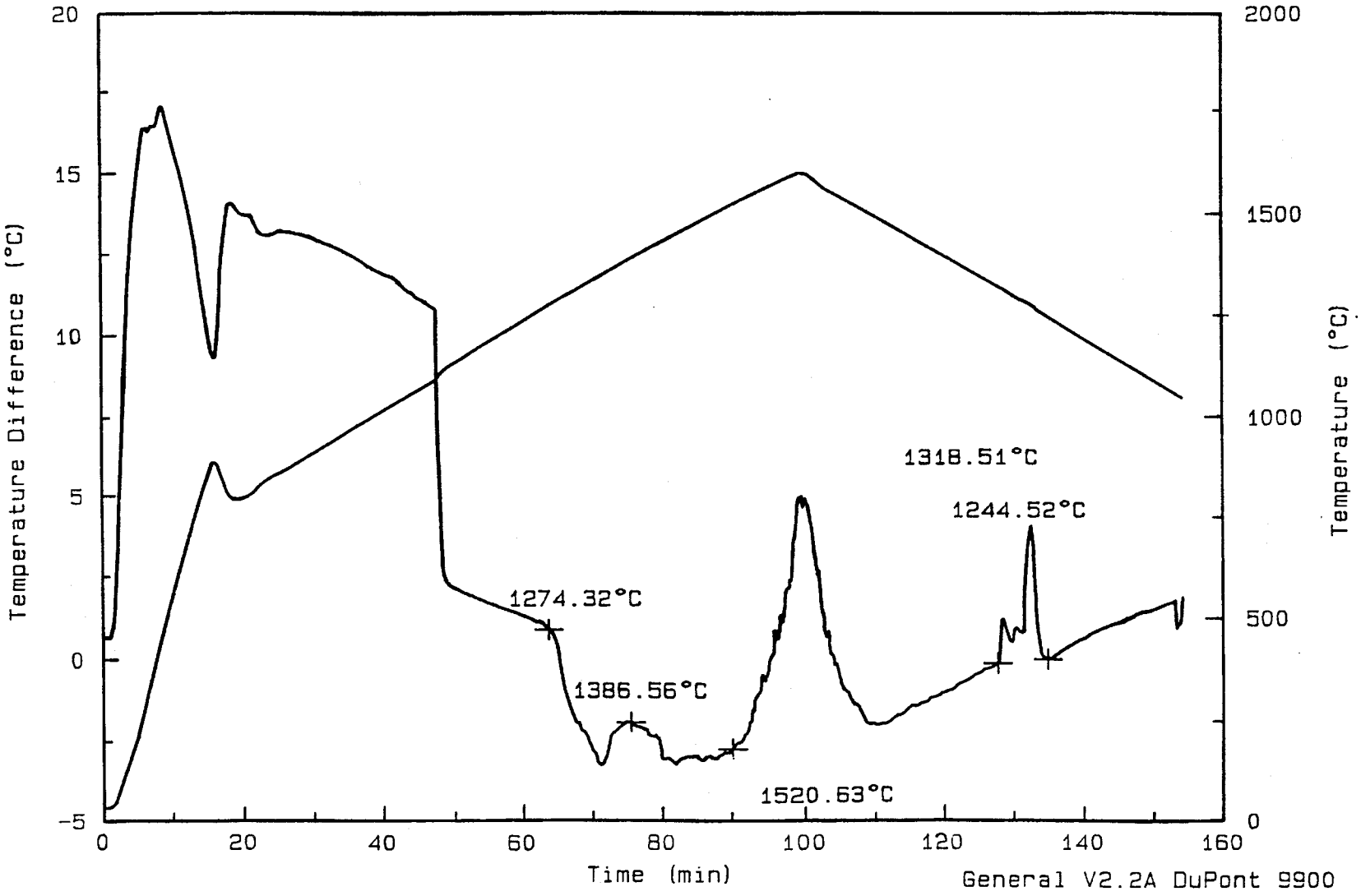

FIG. 11 is a graph showing results from a Differential Thermal Analysis (DTA). The results shown in FIG. 1 were obtained from a graphite substrate coated with a single coat of slurry comprising 60 wt % Si—30 wt % Hf—10 wt % Cr. The results of the fusion temperature and reactions of this slurry mixture are shown in FIG. 11, and these results will be discussed in more detail below in the Detailed Description of the Preferred Embodiments.

Figure 12:
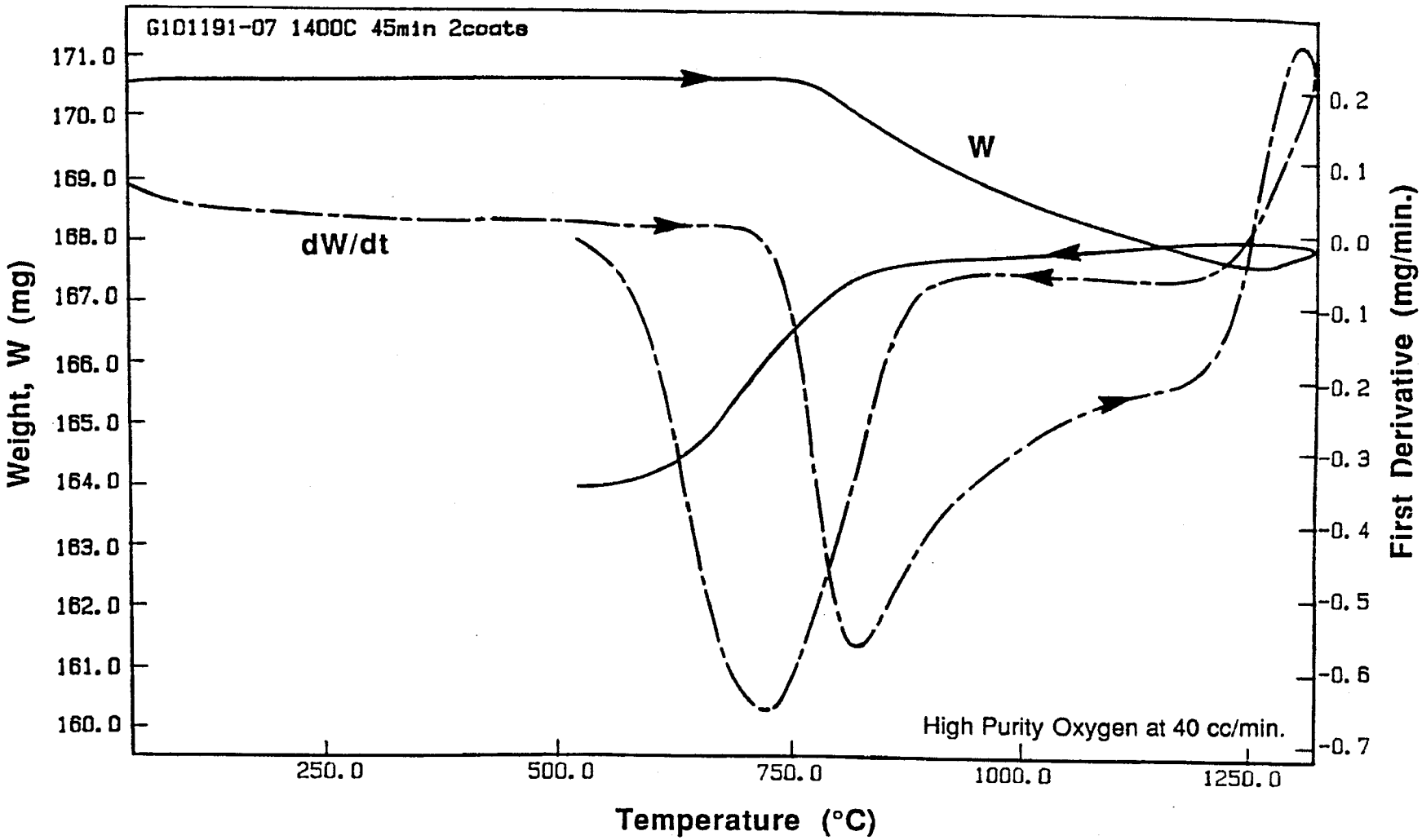

FIG. 12 is a graph showing the oxidation resistance of a graphite substrate coated with two coats of a slurry, each coat comprising 60 wt % Si—30 wt % Hf—10 wt % Cr. Each coat was fused at 1400° C. for 45 minutes. The oxidation resistance shown in FIG. 12 is measured by weight loss determinations in flowing oxygen in a Thermal Gravimetric Analyzer (TGA). The results shown in FIG. 12 indicate some carbon oxidation through cracks in the coating occurring predominantly at a temperature range of 700° C. to 800° C. As will be discussed in more detail below, it is possible to avoid oxidation by eliminating through-coating cracks. This approach can be successful if cracking is localized to the finely distributed silicide phases and if they are surrounded by the silicon phase with lower stress levels. In practice this is accomplished by fusing at the lowest temperature and shortest time permissible to achieve a dense, uniform coating, which for the silicon-hafnium-chromium system was found to be 1300° C. for twenty minutes.

Figure 13:
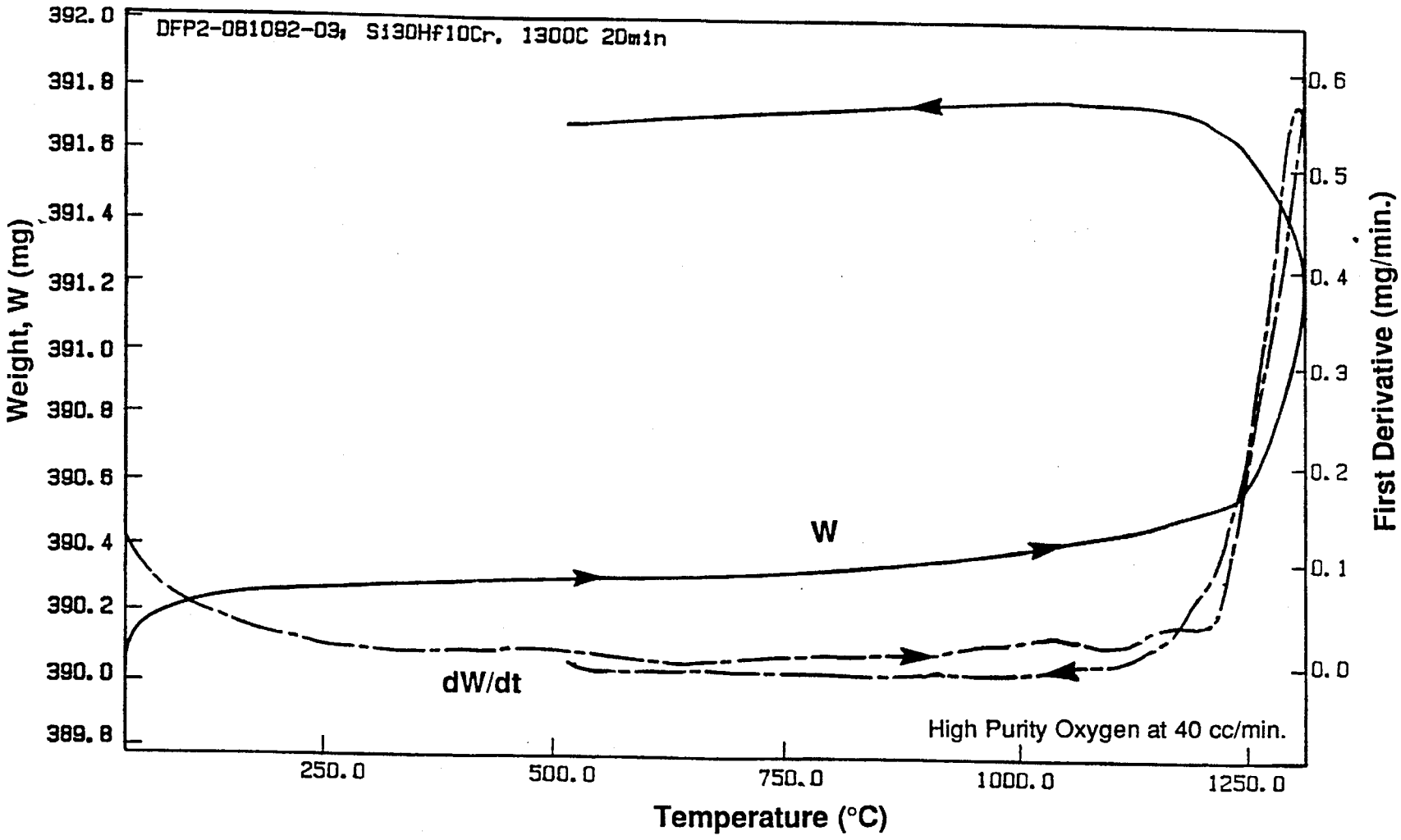

FIG. 13 is a graph similar to the graph of FIG. 12, showing TGA weight loss data. The TGA weight loss data shown in FIG. 13 is for a DFP-2 graphite substrate coated with two coats of a slurry, each coat comprising 60 wt % Si—30 wt % Hf—10 wt % Cr. Each coating was fused at 1300° C. for twenty minutes. The TGA weight loss data shown in FIG. 13 is for the specimen shown in the optical metallographic image of FIG. 4 of the drawings.

Figure 14:
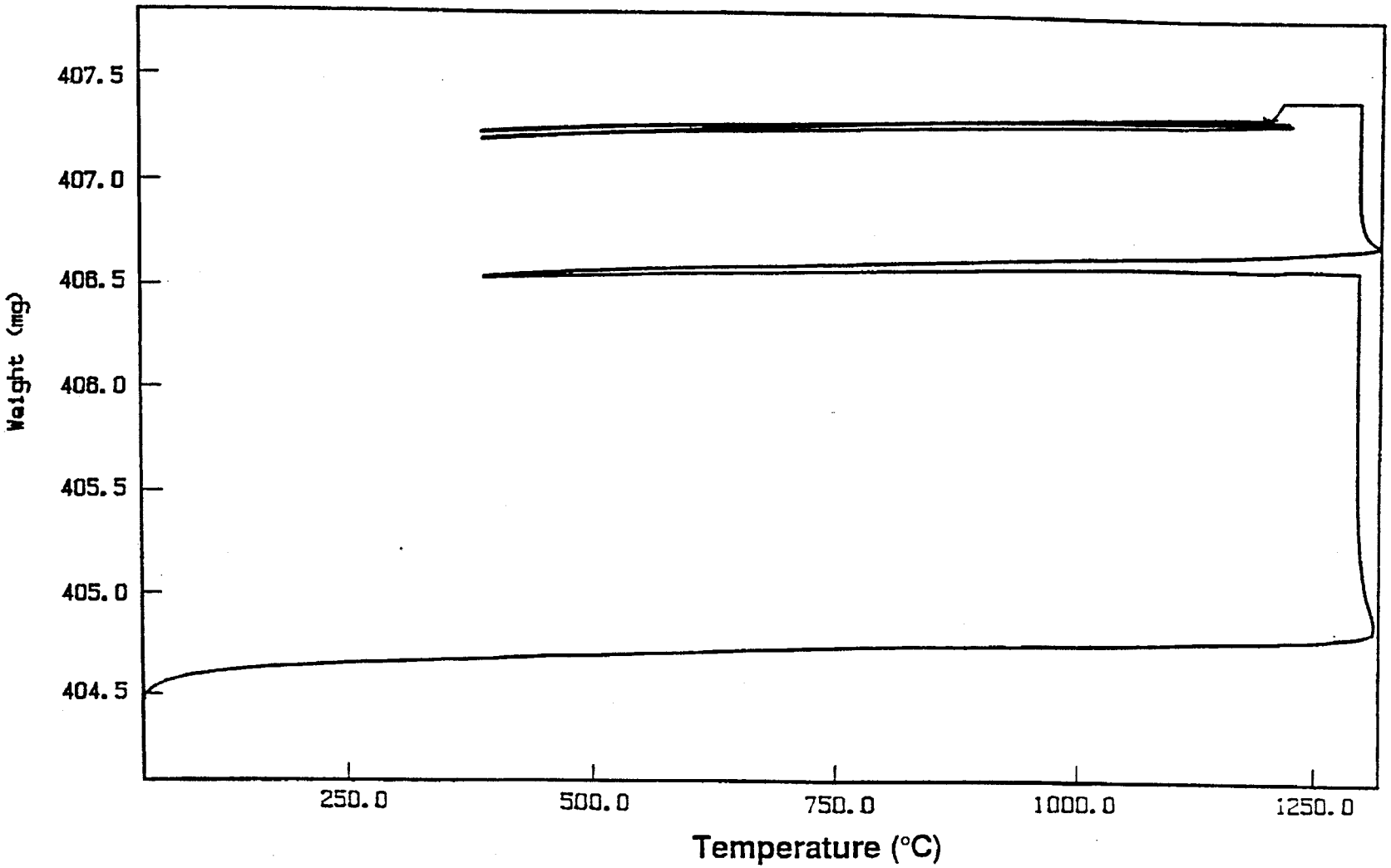

FIG. 14 is a graph, like FIGS. 12 and 13, showing TGA weight loss. The data shown in FIG. 14 was obtained by testing of a DFP-2 graphite substrate coated with three coats of a slurry, each coat comprising 60 wt % Si—30 wt % Hf—10 wt % Cr, each coat fused as 1300° C. for twenty minutes. The data shown in FIG. 14 was obtained from a sample similar to the one shown in FIG. 7 but having three coats.

Figure 15:
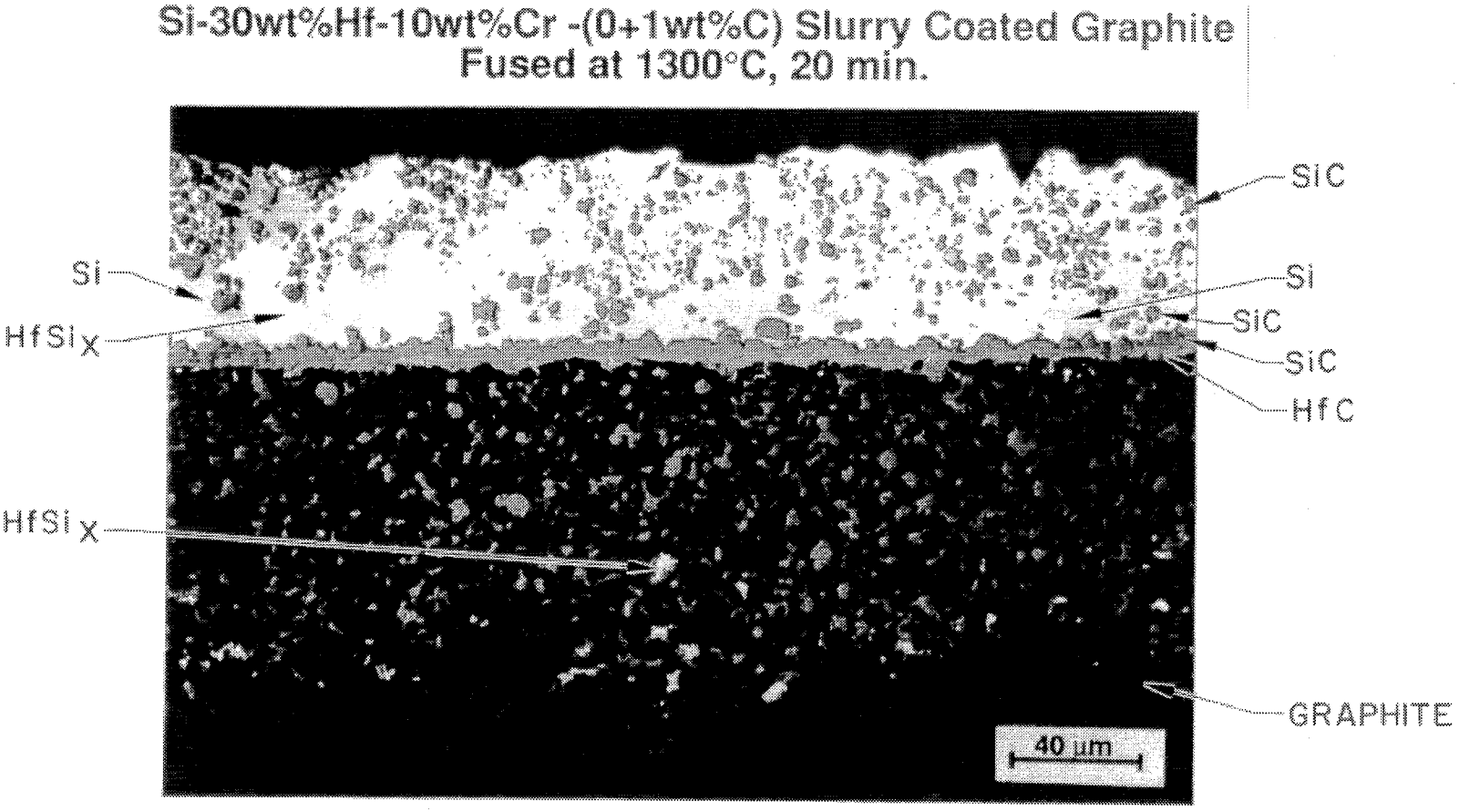

FIG. 15 is an optical metallographic image of a cross section of a DFP-2 graphite substrate coated with two coats of slurry. The first coat of slurry comprised 60 wt % Si—30 wt % Hf—10 wt % Cr and was fused at 1300° C. for twenty minutes. The second coat was a slurry comprising 59 wt % Si—30 wt % Hf—10 wt % Cr—1 wt % C and was fused at 1300° C. for twenty minutes.

Figure 16:
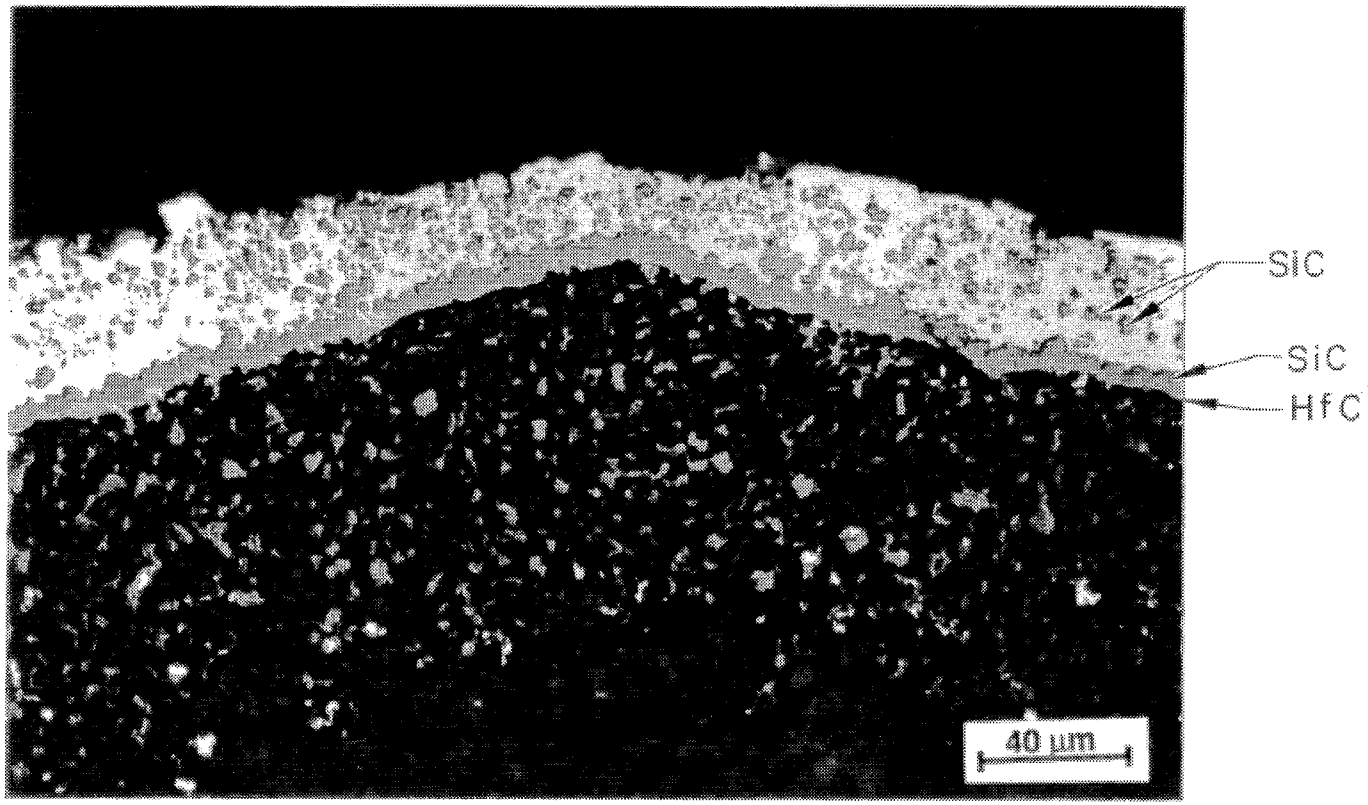

FIG. 16 is an optical metallographic image of a cross section of a DFP-2 graphite substrate coated with two coats of slurry. The first coat of slurry comprised 59 wt % Si—30 wt % Hf—10 wt % Cr—1 wt % C and was fused at 1300° C. for twenty minutes. The second coat was a slurry comprising 59 wt % Si—30 wt % Hf—10 wt % Cr—1 wt % C and was fused at 1300° C. for twenty minutes.

Figure 17:
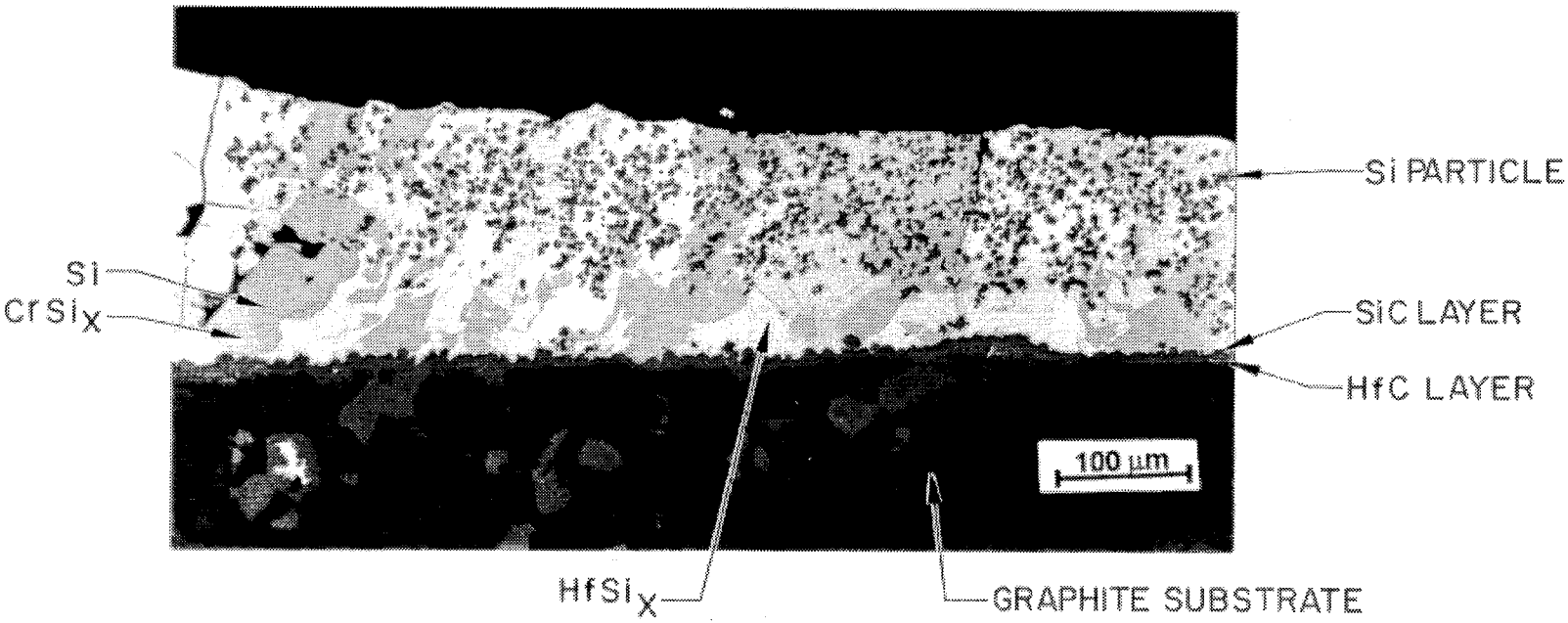

FIG. 17 is an optical metallographic image of a cross section of a CMT graphite substrate coated with two coats of slurry. The first coat of slurry comprised 60 wt % Si—30 wt % Hf—10 wt % Cr and was fused at 1400° C. for twenty minutes. The second coat of slurry comprised 59 wt % Si—30 wt % Hf—10 wt % Cr—1 wt % C and was fused at 1400° for twenty minutes.

Figure 18:
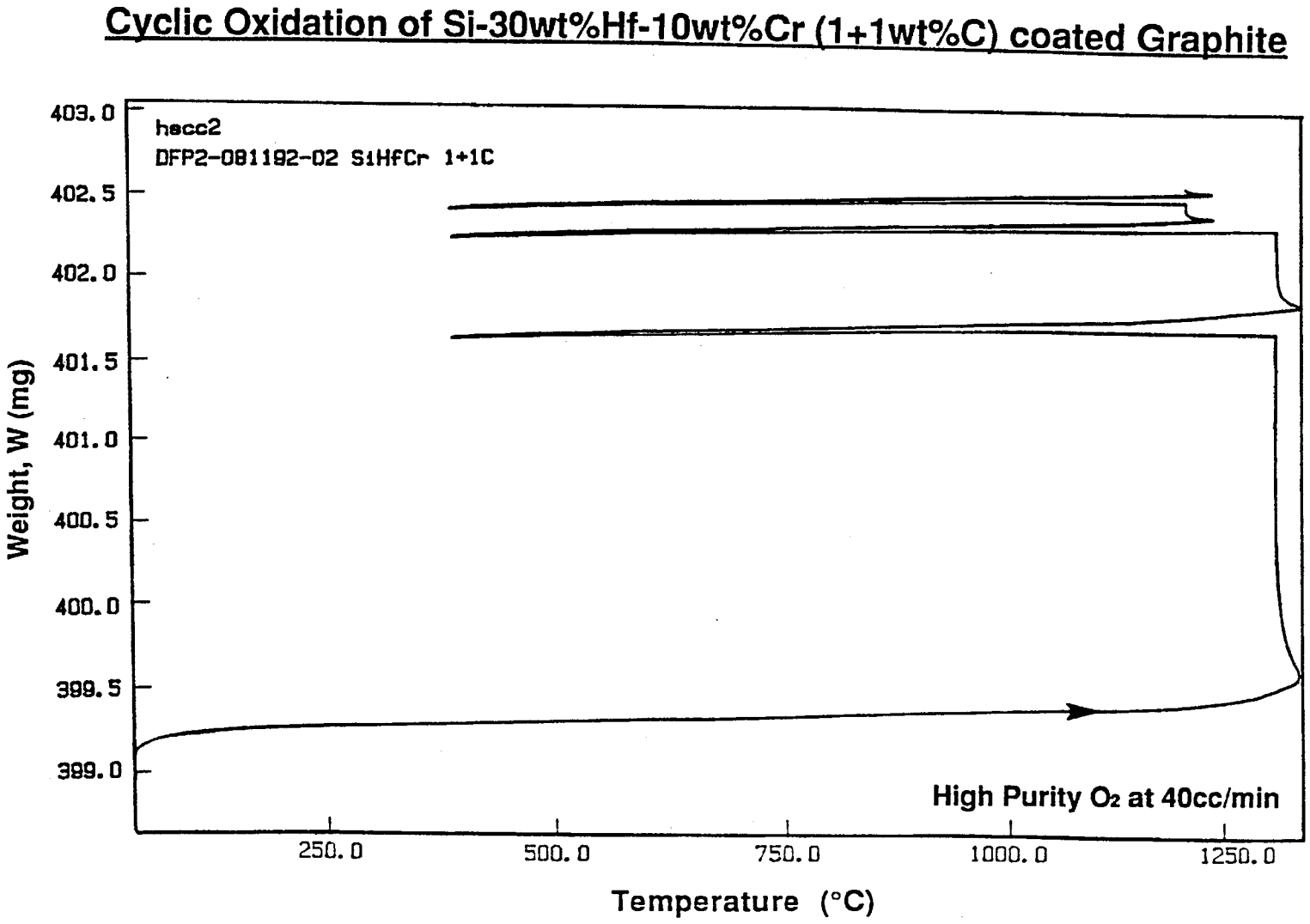

FIG. 18 is a graph, similar to FIGS. 12, 13 and 14, showing TGA weight loss. The TGA weight loss data shown in FIG. 18 is for a DFP-2 graphite substrate coated with two coats of a slurry. The first coat of slurry comprised 59 wt % Si—30 wt % Hf—10 wt % Cr—1 wt % C fused at 1300° C. for twenty minutes. The second coat of slurry comprised 59 wt % Si—30 wt % Hf—10 wt % Cr—1 wt % C and was fused at 1300° C. for twenty minutes. The TGA weight loss data shown in FIG. 18 is data obtained as a sample was subjected to four hours of cyclic oxidation of the kind described with reference to FIG. 7 above. The weight loss data shown in FIG. 18 indicates that there was no weight loss at any time during the cyclical testing. There was only weight gain as a result of oxidation of the outer surface of the coating.

DETAILED DESCRIPTION OF THE PREFERRED EMBODIMENTS:

As will be described in more detail below, the specific embodiments of the present invention which will be described in this detailed description comprised four types of carbon based substrates, four different slurry compositions and testing at isothermal and cyclic conditions.

FIGS. 1–10 and 15–17 are optical metallographic images showing the structures of specific coatings and substrates existing under varied conditions, such as, as fused without subsequent testing, after fusion and isothermal testing, and after fusion and cyclic testing.

FIG. 9 shows a coating made from a slurry containing the refractory metals zirconium and chromium and containing silicon.

FIG. 10 shows a coating made from a slurry containing the refractory metal titanium and containing silicon.

The temperatures and times of fusion for the various coatings are described in the brief description of the drawing views.

FIGS. 15–17 show coatings made from slurries containing the refractory metals Hafnium and Chromium and containing Silicon and containing a fine carbon particulate.

FIG. 11 is a Differential Thermal Analysis (DTA) graph which shows results of the fusion temperature and reactions of the coating of a graphite substrate with a single coating of slurry comprising 60 wt % Si—30 wt % Hf—10 wt % Cr.

FIGS. 12–14 and 18 are thermal gravemetric analyzer (TGA) weight loss graphs.

The weight loss graph shown in FIG. 12 is for a coating fused at a temperature and for a time period which were just a little too high. The resulting microstructure of the coating permitted some penetration of oxygen through the coating in a certain range of temperatures during cyclic testing.

FIGS. 13–14 and 18 are TGA weight loss graphs showing the complete elimination of through-coating cracks accomplished by fused slurry compositions and processing carried out in accordance with the present invention.

As indicated in the brief description of the drawing views, and as will be discussed in more detail below, four types of carbon based substrates have been used in the specific embodiments described in this application.

These carbon based substrates comprise two types of graphites, CMT graphic (manufactured by Union Carbide Corporation) and DFP-2 graphite (supplied by Poco Graphite, Inc.).

The carbon based substrates also included a 2-D C/C composite and a 3-D C/C composite.

The pore size in CMT graphite varied in the 5 to 30 micrometer range compared to an average pore size of 0.8 micrometers in the DFP-2 graphite.

The coatings were applied to carbon based substrates having dimensions selected to be 3×3×5 millimeters or 6.3 millimeter diameter×5 millimeter height. These dimensions are both suitable for oxidation tests in a Perkin-Elmer thermal gravimetric analyzer (TGA 7).

Substrate (specimen) sizes of about 13×13×4 millimeters and larger were employed for isothermal oxidation tests conducted in furnace air.

The substrates (specimens) were hand polished through 600 grit SiC paper and ultrasonic cleaned with acetone before the coating was applied.

In the preparation of the Si—Hf—Cr slurry, high purity Si, Cr, and Hf powders with particle sizes of less than 325 mesh were weighed to a desired composition (e.g., Si—30 wt % Hf—10 wt % Cr) and blended with an organic lacquer vehicle and acetone in a ball mill for about an hour to form a slurry. The solid-to-liquid ratio of the slurry was adjusted to produce a viscosity suitable for the application of slurry on to the specimens.

In the preparation of the Si—Hf—Cr—C slurry used for applying one or more of the coatings to the specimens shown in FIGS. 15–17 (and to the specimens tested as shown in FIG. 18), the slurry was doped with particulate carbon (−325 mesh size).

The carbon based substrate specimens were held using a sapphire fiber inserted through a hole in the specimen. The dipping speed of the sample through slurry was adjusted in order to achieve a desired coating thickness. The thickness of the final coating was controlled by coating density which was calculated as the weight gain per unit area after the coating was applied.

The coating density for a majority of the coatings used in the study varied between 40 to 70 mg/cm$^2$/coat.

The as-coated samples were then given a vacuum fusion treatment to permit alloying, interfacial reactions with carbon and interdiffusion. The fusion temperature and reactions were studied using differential thermal analysis (DTA). An example of DTA results from a Si—30 wt % Hf—10 wt % Cr slurry mixture is shown in FIG. 11. The plot shows significant melting begins at temperatures in excess of 1274° C. During cooling, solidification begins at about 1318° C. and is completed at about 1245° C.

Based on this information, fusion temperatures were selected in the 1300° to 1450° C. range for this composition.

The treatments were conducted in a vacuum of $10^{-5}$ Torr at several temperatures and for twenty to forty minutes, in order to understand the influence of process temperature and time on the coating microstructure and properties.

In most instances, each sample was subjected to a second coat with identical procedures to assure a complete and dense coating.

The CMT graphite and 3-D C/C composite with large pore sizes gave rise to greater penetration of fused metal into the matrix and a relatively thin surface coating, compared with the DFP-2 graphite and 2-D C/C composite.

Fused slurry coatings of Si—Zr—Cr and Si—Ti were prepared in a similar manner.

Oxidation tests, including cyclic tests, of coated samples were conducted using TGA (see FIGS. 12–14) in high purity oxygen flowing at 40 sccm.

Additional isothermal tests were conducted in an air furnace.

Metallurgical reactions occurring at the graphite surface were studied by evaluating the coating surface and cross-sections using Auger electron spectroscopy (AES), optical metallography, scanning electron microscopy (SEM), and x-ray analysis.

Si—Hf—Cr Coatings

SEM images of the as-coated specimens and metallographic examination of their cross-sections provided information on grain size, phase distributions and cracks within the coating.

Figure 1:
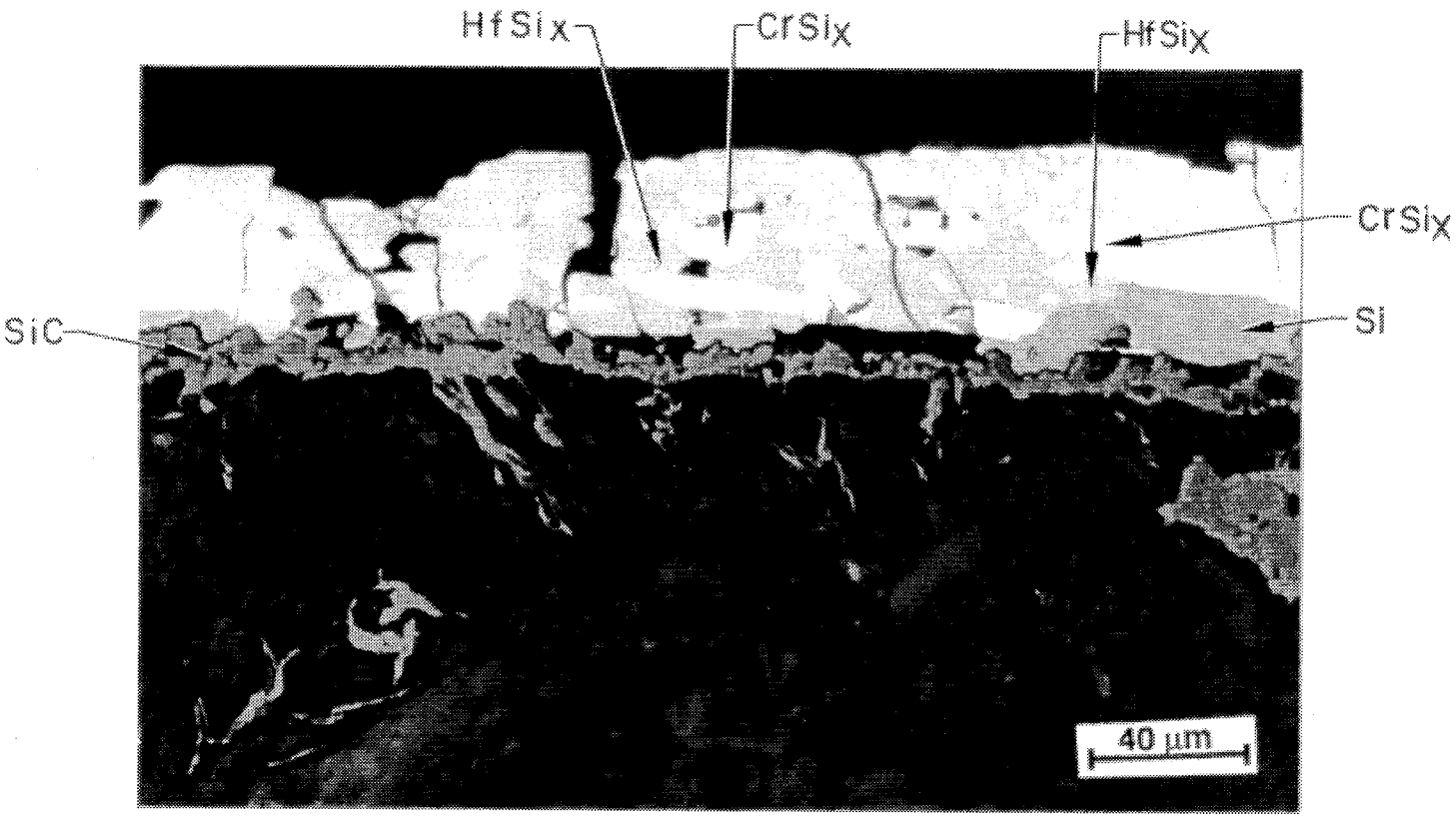
Figure 2:
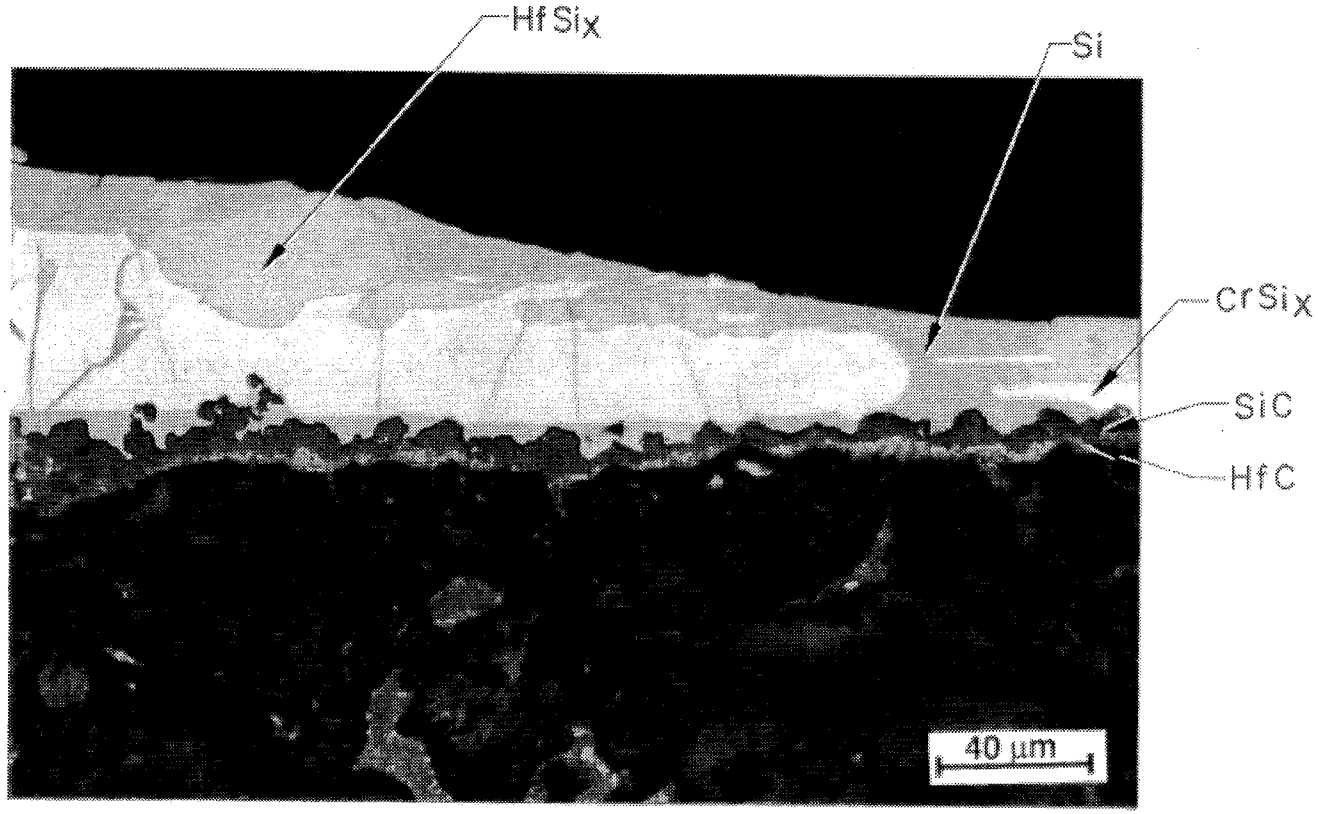
FIG. 2 is an optical metallographic image of a cross section of a CMT graphite substrate coated with a single coat of slurry comprising 60 wt % Si—30 wt % Hf—10 wt % Cr. The coating was fused at 1350° C. for twenty minutes.
Figure 3:
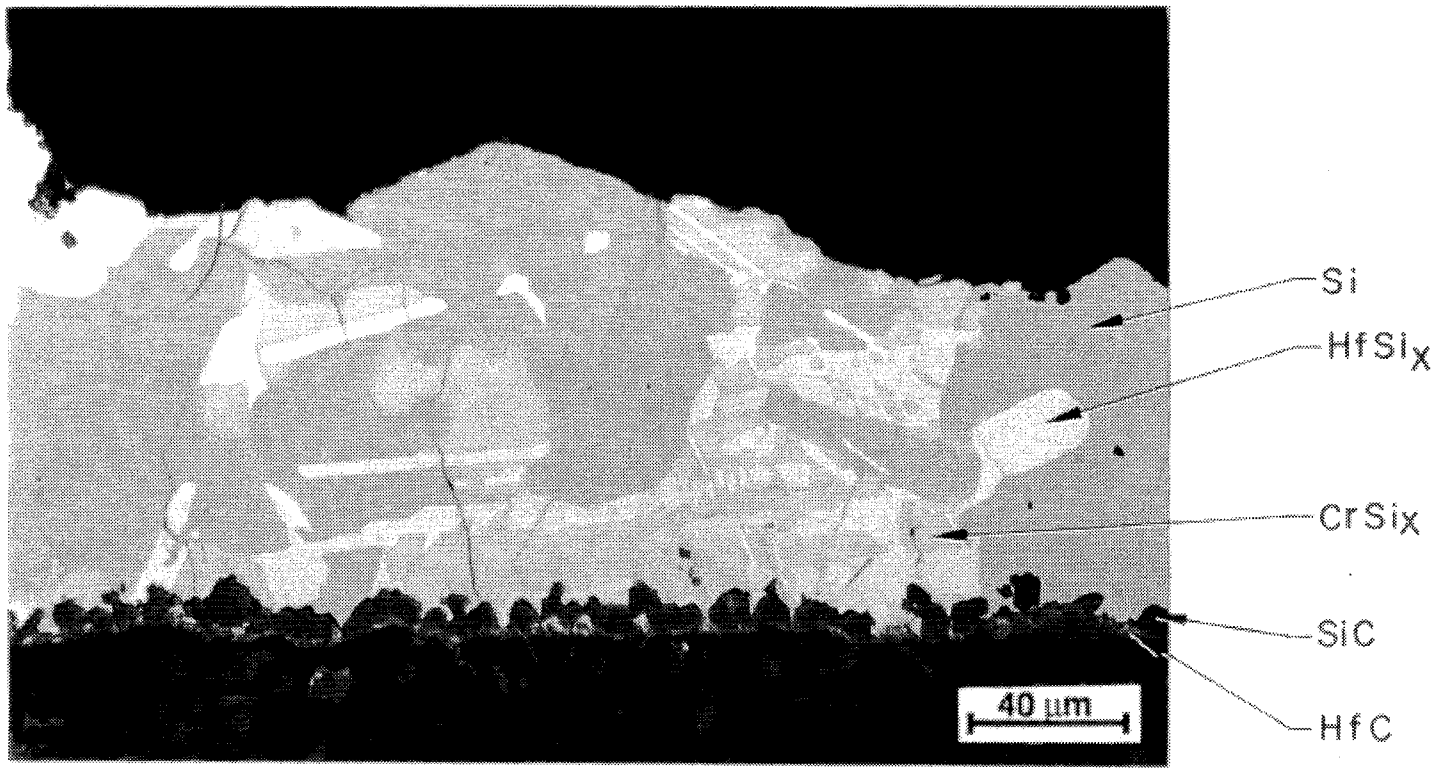
FIG. 3 is an optical metallographic image of a cross section of a CMT graphite substrate coated with a single coat of slurry comprising 60 wt % Si—30 wt % Hf—10 wt % Cr. The coating was fused at 1300° C. for twenty minutes.

FIGS. 1–3 show examples of metallographic images of Si—30 wt % Hf—10 wt % Cr coated CMT graphite, fused at 1400°, 1350° and 1300° C. temperatures for twenty minutes. Cracks were most abundant in the 1400° C. fused specimen and least in the 1300° C. fused specimen. Also for the same thickness of the coating, the 1300° C. fused specimens resulted in the finest grain size. Typically the grain size increases with higher temperature and time of fusion.

Doping the Si—Hf—Cr slurry with particulate carbon (−325 mesh size) and fusing the slurry at an elevated temperature (in the range of 1300° C. to 1450° C.) as described in more detail below with reference to FIGS. 15–18 enhances grain refinement.

Each of the coatings exhibited three predominant phases, which were identified using AES and x-ray microanalyses.

The dark phase is identified to be Si, the light phase contained primarily Cr and Si suggesting a chromium silicide, while the lighter phase is found to be hafnium silicide.

The grainy darker phase, as well as the darker and relatively contiguous layer adjacent to the carbon substrate were found to be SiC.

In most specimens a lighter layer is sandwiched between the C substrate and SiC layer and is found to be a Hf-rich carbide layer.

Thus the coating structure consists of a composite layer, typically about 4 to 8 μm in thickness, with two carbide layers rich in Hf and Si, followed by a multiphase coating (approximately 40 to 100 μm thickness) consisting of Si and silicides of Cr and Hf.

The composite layer is affected only to a minor degree by the temperature and time of fusion, within the range of parameters examined, and appears to act as a barrier to further diffusion of carbon.

Adhesion of the Coatings

All the coatings exhibited good adhesion to the substrate in the as-fused condition, and after on isothermal or cyclic oxidation.

The coatings formed by reaction with the substrate, which included interdiffusion as well as pore penetration of the substrate. These factors may account for the excellent adhesion observed for all the coatings, viz., Si— Hf—Cr, Si—Zr—Cr and Si—Ti systems. Good adhesion and some degree of pore penetration are essential for improved oxidation resistance.

Cracks in the Coatings

Cracks are found in all the coatings, with most of them terminating at the SiC layer.

For the Si—30 wt % Hf—10 wt % Cr and the Si—18 wt % Zr—11.7 wt % Cr compositions of the coating, through-coating cracks are more readily found in the 1350° C. and 1400° C. fused specimens compared to the 1300° C. fused specimen.

For a Si—23 wt % Ti composition, a fusion at 1400° C. for twenty minutes was found to be optimal.

Cracks are most prevalent in the silicides (light phases), and often are blunted in the Si phase.

Since the CTE of silicides is higher than that of Si, it is likely that tensile stresses build into these phases and result in cracking during the cool down from fusion temperature.

Even though the cracks are unavoidable, it is possible to avoid oxidation by eliminating through-coating cracks.

This approach can be successful if cracking is localized to the finely distributed silicide phases and if they are surrounded (in the as fused condition of the coating) by the Si phase with lower stress levels. In practice this was accomplished by fusion at the lowest temperature and shortest time permissible to achieve a dense uniform coating, which for the Si—Hf—Cr system was found to be 1300° C. for twenty minutes.

Distributing fine hard particulate within the coating (as will be described in more detail below with reference to FIGS. 15–18) can also arrest cracks transmitted across grain boundaries.

Specimens with large inter-connected porosity, viz., CMT graphite and 3-D C/C, also show more cracking than the others. This extensive cracking is believed to be in part due to the absorption of coating material into the interior, resulting in reduced coating thickness and altered coating composition. Typically a disproportionally large amount of SiC formed within the pores of carbon substrates resulting in a lower volume fraction of silicon phase within the coating. Higher propensity of cracking in these specimens may be explained as due to high volume fraction of silicide phases and their higher susceptibility to cracking.

Application of more than one coat greatly reduced the cracking susceptibility by maintaining an appropriately large coating thickness (typically in the 40 to 100 μm range) and composition of the coating in the desired range.

An example of such a Si—Hf—Cr coating with no through-coating cracks is shown in FIG. 4.

Oxidation Tests

Oxidation resistance of the various coatings was measured by weight loss determinations in flowing oxygen in a TGA. See FIGS. 12–14 and 18.

The results show that greatest weight loss occurs at about 800° C. for graphite specimens fused at 1350° and 1400° C. See FIG. 12.

No such weight loss was observed for specimens fused at 1300° C. for twenty minutes. See FIGS. 13–14 and 18.

For all specimens, a small weight gain was observed at temperatures above 1200° C. and is due to oxidation of the coating material.

FIG. 6 shows a 3-D C/C composite specimen coating with Si—30 wt % Hf—10 wt % Cr slurry and subjected to oxidating in a TGA to 1300° C. A small oxide skin is evident but not fully resolved in this micrograph. The oxide film was identified by AES to be a hafnium oxide.

Based on these studies it was determined the Si—Hf—Cr coating fused at 1300° C. for twenty minutes is most resistant to oxidation and is a result of no through-coating cracks.

Si—Hf—Cr coatings fused at 1300° C. also withstood four one hour cycles of oxidation between room temperature and 1300° C. See FIGS. 14 and 18. The cycles included two cycles from 400° C. to 1300° C. with one hour hold times, followed by two cycles to 1200° C. with one hour hold times.

Only a small weight gain was observed during the initial hold cycles as shown in FIG. 14 for a triple coated graphite specimen. The weight gain represents the oxide film grown on the coating whose thickness is estimated to be about 10 μm from optical cross-sections, an example of which is shown in FIG. 7.

The good cyclic oxidation resistance of these coatings permits them to be candidates for applications requiring elevated temperature excursions.

Additional isothermal oxidation tests (see FIGS. 6, 8, 9 and 10) conducted in air up to 1600° C. with one hour hold times at the temperature showed only a small weight gain, representing oxidation of the coating.

In addition to the formation of an oxide layer, there were also significant microstructural changes in specimens oxidized at temperatures in excess of 1300° C.

Most commonly refractory metals are depleted from the coating layer and are diffused to its outer surface and from a refractory metal rich oxide layer. This oxide layer is protection for further oxidation at elevated temperatures.

FIG. 8 shows a Si—30 wt % Hf—10 wt % Cr slurry coating subjected to oxidation at 1500° C. for one hour. Only a small portion of the coating is oxidized (about 10 μm), and the coating shows a completely recrystallized microstructure. X-ray analysis shows the coating itself is depleted in Hf and Cr. The outer oxide layer is found to be rich in Hf and Si with an inner layer of $Cr_2O_3$, which is not resolved in the micrograph.

In summary, these results show excellent stability of these coatings under oxidative conditions to 1600° C., despite major structural reorganizations occurring within the coating.

Si—Zr—Cr and Si—Ti Coatings

Analogous to the Si—Hf—Cr system, compositions of Si—Zr—Ti and Si—Ti were examined for potential benefits.

A near eutectic composition of Si—22 wt % Ti for Si—Ti system and an estimated eutectic composition of Si—18 wt % Zr—11.7 wt % Cr for Si—Zr—Cr system were selected.

Coatings on DFP-2 graphite were prepared using procedures similar to the Si—Hf—Cr coatings.

Oxidation tests were conducted in a TGA system up to 1300° C. in flowing oxygen. Metallographic cross-sections of two of these coatings surviving the 1300° C. tests are shown in FIGS. 9 and 10. It was found, in a manner analogous with the Si—Hf—Cr system, that layered structures form and cracking within the coating is limited to the silicide phases.

The major features of fused slurry coatings of Si—Hf—Cr, Si—Zr,Cr and Si—Ti applied to graphite and C/C composites and the influence of process parameters on microstructure, cracking of the coating and oxidation resistance are summarized below.

Si—Hf—Cr slurry coated graphite withstood oxidation in air up to 1600° C. for one hour and cyclic oxidation to 1300° C. C/C composites tested satisfactorily to oxidation up to 1300° C. for one hour.

Si—Zr—Cr and Si—Ti coated graphite specimens tested satisfactorily under isothermal and cyclic oxidation conditions for temperatures up to 1300° C.

The above coatings limited cracks in the coating to certain phases and avoided through-coating cracks.

Desired microstructures were achieved by controlling the process parameters.

The coating structure also contains multiple layers, which is beneficial to crack arrest.

Relatively contiguous coatings that cover rough surfaces were readily formed on all carbon materials.

The pores in graphite and the C/C composites were effectively impregnated by the coating, which is essential for improving the oxidation resistance.

All the coatings exhibited excellent adhesion to the substrate. Formation of layered carbides by reaction is considered the primary factor leading to good adhesion of the coating.

Fused slurry process is relatively simple and inexpensive and permits compositional flexibility so that a wide range of materials may be employed for coating structures and for potential property improvements.

In accordance with a further embodiment of the present invention, as will be described immediately below, a fine particulate is introduced into the coating.

In one specific embodiment of the invention the fine particulate is silicon carbide. This will be described in more detail below.

The fine particulate is not, however, limited to silicon carbide or to a carbon particulate introduced into a slurry.

Instead, the fine particulate can be other materials and can be introduced by other techniques.

For example, the particulate can be oxides, nitrides, borides or similar materials; and the particulate can either be formed by reaction during the coating application process or can be introduced directly and retained in the desired form during the coating process.

The particulate can be, for example, hafnium oxide, zirconium oxide, aluminum oxide, silicon oxide, hafnium nitride, silicon nitride, hafnium diboride or similar compounds.

The other methods that can be employed to introduce the particulate include chemical vapor deposition (CVD), physical vapor deposition (PVD), and various thermal spray techniques.

The coatings with the particulate can be applied to substrates other than carbon based substrates. The coatings with the particulates can, for example, be applied to metals, metal alloys and ceramic materials.

The particulate can be introduced in a minimum amount (depending upon the specific particulate added and the coating and substrate materials) to achieve the desired function; and significantly larger amounts (than the minimum amount) of particulate may be employed. For example, a minimum amount of 0.1 weight percent of particulate will in most cases be effective. But amounts of particulate in the range of 1 to 10 weight percent will not negate the effectiveness of the particulate.

The functions of these particulate are (1) to act as crack arresters, so that a propagating crack is actually stopped upon encounter with this hard particle, and/or (2) to enhance nucleation during the coating formation, so that finer grain size is achieved within the coating, which in effect decreases the crack length in the coating.

The main reason for using the fine particulate is to provide a structure which can go to a higher temperature in use.

The formation of the fine particulate in the coating and the distribution of the fine, hard particulate in and between the grains of other phases in the coating are accomplished (in one specific embodiment of the present invention) by doping the Si—Hf—Cr-Slurry with particulate carbon (–325 mesh size) and fusing the slurry coating at an elevated temperature in the range of 1300° C.–1450° C.

The fusion reactions between the added particulate and the major coating materials then form a thermally stable, hard phase of carbide particulate distributed with the multilayered coating. Under appropriate process conditions this fine, hard particulate is predominantly uniformly distributed in the coating matrix and serves as hard obstacles to crack propagation. These obstacles can either arrest cracks or change their direction of propagation and thus reduce the opportunity of a through-coating crack formation.

An example of microstructure obtained by this approach is shown in FIGS. 15 and 16.

The dark, fine precipitates, identified by Auger electron analysis as SiC, serve as the obstacle to crack propagation and also act as grain refiner to produce finer grain size within the coating.

The TGA result obtained from a graphite specimen, Si—Hf—Cr—C slurry coated and fused at 1300° C. for twenty minutes, is similar to that shown in FIG. 13.

Because of its resiliency and ability to accommodate stresses, the coating also withstood four 1-hour cycles of oxidation between room temperature and 1300° C. These results are shown in FIG. 18.

As described above in this application with reference to FIGS. 1–14, it has been shown that a properly designed microstructure containing multiple phases improves the oxidation behavior.

Similar and further improvements may be obtained by inclusion of appropriate particulate in the coating as shown by FIGS. 15–18.

This is a result of the ability of particulate in preventing or stopping through-cracks in the coating.

FIG. 17 shows the micro structure of a coating with a first coat of Si—30 wt % Hf—10 wt % Cr fused at 1400° C. for twenty minutes followed by a Si—30 wt % Hf—10 wt % Cr—1 wt % C also fused at 1400° C. for twenty minutes. Large cracks are seen predominantly in areas void of particulate (see the extreme left hand part of FIG. 17), suggesting that the particulate minimize crack nucleation or arrest them effectively.

The embodiments of the invention shown in FIGS. 15–18 show carbon added to a Si—Hf—Cr coating improves oxidation protection at elevated temperatures and during thermal changes.

The improved oxidation resistance is a result of the specially designed particulate distributed in the micro structure.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

We claim:

1. A method of providing a surface of a carbon containing substrate with a crack-limiting coating which prevents developing cracks from extending through the coating both under isothermal conditions and when the temperature of the coating is changed and which prevents oxygen ambient to the coating from contacting the carbon containing substrate, said method comprising, applying a slurry coating composition to the surface of the carbon containing substrate, said slurry coating composition containing silicon, said slurry coating composition containing at least one refractory metal and an element which lowers the melting point of the slurry coating composition by eutectic melting, said slurry containing an additional particulate, fusing the slurry coating composition onto the carbon containing substrate to produce a multilayer coating on the surface of the carbon containing substrate, said fusing the slurry coating composition onto the carbon containing substrate including a reaction between said substrate and said coating composition, said multilayer coating having a first layer contiguous to and adhered to the substrate and comprising silicon carbide and having a second multiphase layer, producing a polycrystalline microstructure in the multiphase layer and in which microstructure, A. all of the grains of all of the phases in the multiphase layer are smaller than the thickness of the layer, B. at least a first one of the phases comprises a refractory material (1) which provides resistance to oxidation at high temperatures, but (2) which has a mismatch in coefficient of thermal expansion with the substrate material so as to be subject to cracking of grains under thermal stresses which may be incurred during the usage of the coated substrate, C. at least a second one of the phases in the multiphase layer comprises grains (1) which surround grains of said first one of the phases and (2) which have a sufficiently low mismatch in coefficient of thermal expansion with the substrate materials so as to cause a crack extending through a grain in said first one of the phases to be stopped in an adjacent grain or grains of said second one of the phases, said producing said polycrystalline microstructure including, heating said slurry coating composition on said carbon containing substrate to a temperature high enough and for a period of time long enough to produce the multiple phases, limiting said heating of the said slurry coating composition to a temperature low enough and for a period of time short enough to prevent the grains in the multiphase layer from growing as large as the thickness of the multiphase layer, and allowing cooling of said produced polycrystalline microstructure, wherein said particulate remains as a particulate after said heating and cooling and are distributed in at least one of the layers, and wherein the combination of the polycrystalline microstructure and the distributed particulate distribute cracks to individual grains in said first phase and limit the cracks to the individual grains to make all cracks discontinuous and prevent any crack from extending through all of the layers of the entire coating.

2. The invention defined in claim 1 wherein the carbon containing substrate is graphite.

3. The invention defined in claim 1 wherein the carbon containing substrate is a carbon—carbon composite.

4. The product of the method of claim 3.

5. The invention defined in claim 1 wherein the particulate is an oxide.

6. The product of the method of claim 5.

7. The invention defined in claim 1 wherein the particulate is selected from the class consisting of hafnium oxide, zirconium oxide, silicon oxide, and aluminum oxide.

8. The invention defined in claim 1 wherein the fine, hard particulate is a nitride.

9. The invention defined in claim 1 wherein the particulate is selected from the class consisting of hafnium nitride and silicon nitride.

10. The invention defined in claim 1 wherein the particulate is hafnium diboride.

11. The invention defined in claim 1 wherein the particulate are carbide particles.

12. The invention defined in claim 1 wherein the particulate enhance nucleation during the coating formation.

13. The invention defined in claim 1 wherein silicon is the element which lowers the melting point of the slurry coating composition by eutectic melting and wherein the fusing produces phases of refractory metal, metal silicides, carbides and elemental silicon.

14. The invention defined in claim 13 wherein the slurry contains hafnium and chromium.

15. The product of the method of claim 14.

16. The invention defined in claim 13 wherein the slurry contains zirconium and chromium.

17. The product of the method of claim 16.

18. The invention defined in claim 13 wherein the particulate in the slurry is particulate carbon.

19. The product of the method of claim 18.

20. The invention defined in claim 13 wherein the slurry contains an organic material which provides flow viscosity and which dries out after the slurry is applied to the substrate.

21. The invention defined in claim 1 wherein the fusing is done at a temperature in the range of 1300° C. to 1400° C. for up to about twenty minutes.

22. The invention defined in claim 1 wherein the particulate in the slurry is a carbide.

23. The invention defined in claim 1 wherein the refractory material permits the formation of oxides on the outside surface of the coating and wherein the oxides are protective to subsequent oxidation.

24. The product of the method of claim 1.

25. The invention defined in claim 1 wherein the fusing is done at a temperature of 1300° C. for twenty minutes.

26. A substrate product having an encapsulating crack-limiting coating which prevents developing cracks from extending through the coating both under isothermal conditions and when the temperature of the coating is changed and which prevents oxygen ambient to the coating from penetrating through the coating and contacting the substrate, said substrate product comprising, a carbon containing substrate, a multilayer coating encapsulating the surface of the carbon containing substrate, said multilayer coating being produced from a slurry coating composition containing silicon, at least one refractory metal, an element which lowers the melting point of the slurry coating composition by eutectic melting, and an additional particulate, said multilayer coating having at least one of the layers adhered to said surface of the carbon containing substrate, said multilayer coating having a coating composition and a fusion processing produced microstructure of fine grained, multiple phases in the layers and in which microstructure, A. all of the grains of all of the phases in at least one layer are grains smaller than the thickness of the layer, B. at least a first one of the phases comprises a refractory material (1) which provides resistance to oxidation at high temperatures, but (2) which has a large enough mismatch in coefficient of thermal expansion with the carbon containing substrate so as to be subject to cracking of grains under thermal stresses incurred during the production of the coated carbon containing substrate, C. at least a second one of the phases comprises grains (1) which surround individual grains of said first one of the phases and (2) which have a sufficiently low mismatch in coefficient of thermal expansion with the carbon containing substrate so as to cause a crack extending through a grain in said first one of the phases to be stopped in an adjacent grain or grains of said second one of the phases, and D. said particulate remains as a particulate after said fusion processing and are distributed in at least one of the layers, and wherein the combination of the produced microstructure and distributed particulate distribute cracks to individual grains in said first phase and limit the cracks to the individual grains to make all cracks discontinuous and prevent any crack from extending through all of the layers of the entire coating.

27. The invention defined in claim 26 wherein the particulate enhance nucleation during the coating formation.

28. A method of providing a surface of a substrate with a crack-limiting coating which prevents developing cracks from extending through the coating both under isothermal conditions and when the temperature of the coating is changed and which prevents oxygen ambient to the coating from contacting the substrate, said method comprising, applying a slurry coating composition to the surface of the substrate, said slurry coating composition containing silicon, said slurry coating composition containing at least one refractory metal and an element which lowers the melting point of the slurry coating composition by eutectic melting, said slurry containing an additional particulate, fusing the slurry coating composition onto the substrate to produce a multilayer coating on the surface of the substrate, said fusing the slurry coating composition onto the substrate including a reaction between said substrate and said coating composition, said multilayer coating having a first layer contiguous to and adhered to the substrate and comprising silicon carbide and having a second multiphase layer, producing a polycrystalline microstructure in the multiphase layer and in which microstructure, A. all of the grains of all of the phases in the multiphase layer are smaller than the thickness of the layer, B. at least a first one of the phases comprises a refractory material (1) which provides resistance to oxidation at high temperatures, but (2) which has a mismatch in coefficient of thermal expansion with the substrate material so as to be subject to cracking of grains under thermal stresses which may be incurred during the usage of the coated substrate, C. at least a second one of the phases in the multiphase layer comprises grains (1) which surround grains of said first one of the phases and (2) which have a sufficiently low mismatch in coefficient of thermal expansion with the substrate materials so as to cause a crack extending through a grain in said first one of the phases to be stopped in an adjacent grain or grains of said second one of the phases, said producing said polycrystalline microstructure including, heating said slurry coating composition on said substrate to a temperature high enough and for a period of time long enough to produce the multiple phases, limiting said heating of the said slurry coating composition to a temperature low enough and for a period of time short enough to prevent the grains in the multiphase layer from growing as large as the thickness of the multiphase layer, and allowing cooling of said produced polycrystalline microstructure, wherein said particulate remains as a particulate after said heating and cooling and are distributed in at least one of the layers, and wherein the combination of the polycrystalline microstructure and the distributed particulate distribute cracks to individual grains in said first phase and limit the cracks to the individual grains to make all cracks discontinuous and prevent any crack from extending through all of the layers of the entire coating.

29. The invention defined in claim 28 wherein the substrate is a metal.

30. The product of the method of claim 29.

31. The invention defined in claim 28 wherein the substrate is a metal alloy.

32. The product of the method of claim 31.

33. The invention defined in claim 28 wherein the substrate is a ceramic.

34. The product of the method of claim 33.

35. A method of providing a surface of a substrate with a crack-limiting coating which prevents developing cracks from extending through the coating both under isothermal conditions and when the temperature of the coating is changed and which prevents oxygen ambient to the coating from contacting the substrate, said method comprising, applying a slurry coating composition to the surface of the substrate, said slurry coating composition containing silicon, said slurry coating composition containing at least one refractory metal and an element which lowers the melting point of the slurry coating composition by eutectic melting, fusing the slurry coating composition onto the substrate to produce a multilayer coating on the surface of the substrate, said fusing the slurry coating composition onto the substrate including a reaction between said substrate and said coating composition, said multilayer coating having a first layer contiguous to and adhered to the substrate and comprising silicon carbide and having a second multiphase layer, producing a polycrystalline microstructure in the multiphase layer and in which microstructure, A. all of the grains of all of the phases in the multiphase layer are smaller than the thickness of the layer, B. at least a first one of the phases comprises a refractory material (1) which provides resistance to oxidation at high temperatures, but (2) which has a mismatch in coefficient of thermal expansion with the substrate material so as to be subject to cracking of grains under thermal stresses which may be incurred during the usage of the coated substrate, C. at least a second one of the phases in the multiphase layer comprises grains (1) which surround grains of said first one of the phases and (2) which have a sufficiently low mismatch in coefficient of thermal expansion with the substrate materials so as to cause a crack extending through a grain in said first one of the phases to be stopped in an adjacent grain or grains of said second one of the phases, said producing said polycrystalline microstructure including, heating said slurry coating composition on said substrate to a temperature high enough and for a period of time long enough to produce the multiple phases, limiting said heating of the said slurry coating composition to a temperature low enough and for a period of time short enough to prevent the grains in the multiphase layer from growing as large as the thickness of the multiphase layer, and allowing cooling of said produced polycrystalline microstructure, and wherein the polycrystalline microstructure distributes cracks to individual grains in said first phase and limits the cracks to the individual grains to make all cracks discontinuous and prevents any crack from extending through all of the layers of the entire coating.

36. A substrate product having an encapsulating crack-limiting coating which prevents development cracks from extending through the coating both under isothermal conditions and when the temperature of the coating is changed and which prevents oxygen ambient to the coating from penetrating through the coating and contacting the substrate, said substrate product comprising, a substrate, a multilayer coating encapsulating the surface of the substrate, said multilayer coating having at least one of the layers adhered to said surface of the substrate, said multilayer coating having a coating composition and a fusion processing produced microstructure of fine grained, multiple phases in the layers and in which microstructure, A. all of the grains of all of the phases in at least one layer are grains smaller than the thickness of the layer, B. at least a first one of the phases comprises a refractory material (1) which provides resistance to oxidation at high temperatures, but (2) which has a large enough mismatch in coefficient of thermal expansion with the substrate so as to be subject to cracking of grains under thermal stresses incurred during the usage of the coated substrate, C. at least a second one of the phases comprises grains (1) which surround individual grains of said first one of the phases and (2) which have a sufficiently low mismatch in coefficient of thermal expansion with the substrate so as to cause a crack extending through a grain in said first one of the phases to be stopped in an adjacent grain or grains of said second one of the phases, and wherein the produced microstructure distributes cracks to individual grains in said first phase and limits the cracks to the individual grains to make all cracks discontinuous and prevents any crack from extending through all of the layers of the entire coating.

* * * * *